US009534743B2

(12) United States Patent
Allen et al.

(10) Patent No.: US 9,534,743 B2
(45) Date of Patent: Jan. 3, 2017

(54) DIRECTIONAL LAMP WITH BEAM FORMING OPTICAL SYSTEM INCLUDING A LENS AND COLLECTING REFLECTOR

(71) Applicants: Gary R. Allen, Cleveland, OH (US); Stanton E. Weaver, Jr., Niskayuna, NY (US); R. Stephen Mulder, Tucson, AZ (US); David C. Dudik, Cleveland, OH (US); Mark E. Kaminski, Cleveland, OH (US)

(72) Inventors: Gary R. Allen, Cleveland, OH (US); Stanton E. Weaver, Jr., Niskayuna, NY (US); R. Stephen Mulder, Tucson, AZ (US); David C. Dudik, Cleveland, OH (US); Mark E. Kaminski, Cleveland, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 0 days.

(21) Appl. No.: 14/083,597

(22) Filed: Nov. 19, 2013

(65) Prior Publication Data

US 2014/0198507 A1 Jul. 17, 2014

Related U.S. Application Data

(63) Continuation of application No. 12/685,287, filed on Jan. 11, 2010, now Pat. No. 8,613,530.

(51) Int. Cl.
*F21K 99/00* (2010.01)
*F21V 13/12* (2006.01)
(Continued)

(52) U.S. Cl.
CPC ..... *F21K 9/50* (2013.01); *F21K 9/137* (2013.01); *F21V 13/12* (2013.01); *F21V 3/00* (2013.01);
(Continued)

(58) Field of Classification Search
CPC ..... F21V 13/14; F21V 13/12; F21V 13/10; F21V 7/041; F21Y 2101/02; F21Y 2105/00; F21Y 2105/001; F21Y 2105/006; F21Y 2105/02; F21Y 2105/022; F21Y 2105/025; F21K 9/137; F21K 9/50
See application file for complete search history.

(56) References Cited

U.S. PATENT DOCUMENTS 5,174,649 A 12/1992 Alston
5,296,724 A 3/1994 Ogata et al.
(Continued)

FOREIGN PATENT DOCUMENTS

EP 1024399 B1 12/2005
EP 1995510 11/2008
(Continued)

OTHER PUBLICATIONS

WT Welford, "Aberrations of Optical Systems," Taylor & Francis, 1 edition, pp. 84-87, Jan. 1, 1986.
(Continued)

*Primary Examiner* — Robert May
(74) *Attorney, Agent, or Firm* — Fay Sharpe LLP

(57) ABSTRACT

A directional lamp comprises a light source, a beam forming optical system configured to form light from the light source into a light beam, and a light mixing diffuser arranged to diffuse the light beam. The light source, beam forming optical system, and light mixing diffuser are secured together as a unitary lamp. The beam forming optical system includes: a collecting reflector having an entrance aperture receiving light from the light source and an exit aperture that is larger than the entrance aperture, and a lens disposed at the exit aperture of the collecting reflector, the light source being positioned along an optical axis of the beam forming optical
(Continued)

system at a distance from the lens that is within plus or minus ten percent of a focal length of the lens.

35 Claims, 11 Drawing Sheets

(51) Int. Cl.

| | |
|---|---|
| *F21V 3/00* | (2015.01) |
| *F21V 5/04* | (2006.01) |
| *F21V 7/00* | (2006.01) |
| *F21Y 101/02* | (2006.01) |
| *F21Y 105/00* | (2016.01) |

(52) U.S. Cl.
CPC .. *F21V 5/04* (2013.01); *F21V 7/00* (2013.01); *F21Y 2101/02* (2013.01); *F21Y 2105/003* (2013.01)

(56) References Cited

U.S. PATENT DOCUMENTS

| | | | | |
|---|---|---|---|---|
| 6,485,160 | B1 | 11/2002 | Sommers et al. | |
| 6,513,949 | B1 | 2/2003 | Marshall et al. | |
| 6,547,416 | B2 | 4/2003 | Pashley et al. | |
| 6,616,299 | B2 * | 9/2003 | Martineau | 362/244 |
| 7,125,160 | B2 | 10/2006 | Wong et al. | |
| 7,213,940 | B1 | 5/2007 | Van De Ven et al. | |
| 7,224,000 | B2 | 5/2007 | Aanegola et al. | |
| 7,332,746 | B1 | 2/2008 | Takahashi et al. | |
| 7,431,477 | B2 | 10/2008 | Chou et al. | |
| 7,479,622 | B2 | 1/2009 | May et al. | |
| 7,482,567 | B2 | 1/2009 | Hoelen et al. | |
| 7,540,631 | B2 | 6/2009 | Watanabe et al. | |
| 7,984,999 | B2 * | 7/2011 | Harbers et al. | 362/231 |
| 8,047,677 | B2 | 11/2011 | Wang | |
| 2001/0036083 | A1 | 11/2001 | Weber et al. | |
| 2003/0156416 | A1 | 8/2003 | Stopa et al. | |
| 2004/0184272 | A1 | 9/2004 | Wright et al. | |
| 2005/0023537 | A1 | 2/2005 | Salam | |
| 2005/0041424 | A1 | 2/2005 | Ducharme | |
| 2007/0019409 | A1 | 1/2007 | Nawashiro et al. | |
| 2007/0278974 | A1 | 12/2007 | Van De Ven | |
| 2008/0062682 | A1 | 3/2008 | Hoelen et al. | |
| 2008/0106887 | A1 | 5/2008 | Salsbury et al. | |
| 2008/0310158 | A1 | 12/2008 | Harbers et al. | |
| 2009/0103293 | A1 | 4/2009 | Harbers et al. | |
| 2009/0103296 | A1 | 4/2009 | Harbers et al. | |
| 2009/0116251 | A1 | 5/2009 | Harbers et al. | |
| 2009/0161356 | A1 | 6/2009 | Negley et al. | |
| 2009/0296384 | A1 | 12/2009 | Van De Ven et al. | |
| 2010/0066255 | A1 | 3/2010 | Roberts | |
| 2012/0069547 | A1 | 3/2012 | Gielen et al. | |

FOREIGN PATENT DOCUMENTS

| | | | |
|---|---|---|---|
| JP | 04-226095 | A | 8/1992 |
| JP | 9073807 | A | 3/1997 |
| JP | 2003-005677 | A | 1/2003 |
| JP | 2008-218089 | A | 9/2008 |
| JP | 2009-049239 | A | 3/2009 |
| JP | 3151223 | U | 6/2009 |
| JP | 2009140778 | A | 6/2009 |
| JP | 2009-158178 | A | 7/2009 |
| JP | 2010-251213 | A | 11/2010 |
| WO | WO 2004/100265 | A2 | 11/2004 |

OTHER PUBLICATIONS

Ray Molony, "Remote Possibilites," pp. 24, 25, at www.Lighting.co.uk, (Dec. 2008).

Luminit, "Light Shaping Diffusers," Technical Data Sheet, pp. 2, at www.luminitco.com, last visited on Jan. 6, 2010.

Luminit, "Architectural/Event Lighting Diffusers," pp. 2, at www.luminitco.com, last visited on Jan. 6, 2010.

Luminit, "LED Lighting Applications," pp. 2, at www.luminitco.com, last visited on Jan. 6, 2010.

PCT Invitation to Pay Additional Fees issued in connection with corresponding WO Patent APplciation No. US 11/20442 filed on Jan. 7, 2011.

PCT Search report issued in connection with corresponding WO Patent application No. US11/020442 filed on Jan. 7, 2011.

Unofficial English translation of Japanese Office Action issued in connection with corresponding JP Application No. 2012-548131 on Feb. 17, 2015.

Unofficial Manual Translation of JP Office Action issued in connection with corresponding JP Application No. 2012-548131 dated Sep. 16, 2014.

Unofficial English Translation of Japanese Office Action issued in connection with corresponding JP Application No. 2012548131 on Nov. 4, 2015.

* cited by examiner

DIRECTIONAL LAMP WITH BEAM FORMING OPTICAL SYSTEM INCLUDING A LENS AND COLLECTING REFLECTOR

This application is a continuation of U.S. Ser. No. 12/685,287 filed Jan. 11, 2010 and is incorporated herein by reference in its entirety.

BACKGROUND

The following relates to the illumination arts, lighting arts, solid state lighting arts, and related arts.

Incandescent and halogen lamps are conventionally used as both omni-directional and directional light sources. A directional lamp is defined by the US Department of Energy in its Energy Star Eligibility Criteria for Integral LED Lamps, draft 3, as a lamp having at least 80% of its light output within a cone angle of 120 degrees (full-width at half-maximum of intensity, FWHM). They may have either broad beam patterns (flood lamps) or narrow beam patterns (e.g., spot lamps), for example having a beam intensity distribution characterized by a FWHM<20°, with some lamp standards specified for angles as small as 6-10° FWHM. Incandescent and halogen lamps combine these desirable beam characteristics with high color rendering index (CRI) to provide good light sources for the display of retail merchandise, residential and hospitality lighting, art work, etc. For commercial applications in North America, these lamps are designed to fit into a standard MR-x, PAR-x, or R-x lamp fixture, where "x" denotes the outer diameter of the fixture, in eighths of an inch (e.g. PAR38 has 4.75" lamp diameter~120 mm). There is equivalent labeling nomenclature in other markets. These lamps have fast response time, output high light intensity, and have good CRI characteristics, especially for saturated red (e.g., the R9 CRI parameter), but suffer from poor efficacy and relatively short lamp life. For still higher intensities, high intensity discharge (HID) lamps are used, at the cost of reduced response time due to the need to heat the liquid and solid dose during the warm-up phase after turning on the lamp, and typically also reduced color quality, higher cost, and moderate lamp life ~10 k-20 k hours.

Although these existing MR/PAR/R spotlight technologies provide generally acceptable performance, further enhancement in performance and/or color quality, and/or reduction in manufacturing cost, and/or increased wall plug energy efficiency, and/or increased lamp life and reliability would be desirable. Toward this end, efforts have been directed toward developing solid-state lighting technologies such as light emitting diode (LED) device technologies. The desirable characteristics of incandescent and halogen spot lamps include: color quality; color uniformity; beam control; and low acquisition cost. The undesirable characteristics include: poor efficacy; short life; excessive heat generation; and high life-cycle operating cost.

For MR/PAR/R spot light applications, LED device technologies have been less than satisfactory in replacing incandescent and halogen lamps. It has been difficult using LED device technologies to simultaneously achieve a combination of both good color and good beam control for spot lamps. LED-based narrow-beam spot lighting has been achieved using white LEDs as point light sources coupled with suitable lenses or other collimating optics. This type of LED device can be made with narrow FWHM in a lamp envelope comporting with MR/PAR/R fixture specifications. However, these lamps have CRI characteristics corresponding to that of the white LEDs, which is unsatisfactory in some applications. For example, such LED devices typically produce R9 values of less than 30, and CRI~80-85 (where a value of 100 is ideal) which is unacceptable for spot light applications such as product displays, theater and museum lighting, restaurant and residential lighting, and so forth.

On the other hand, LED based lighting applications other than spot lighting have successfully achieved high CRI by combining white LED devices with red LED devices that compensate for the red deficient spectrum of typical white LED devices. See, e.g., Van De Ven et al., U.S. Pat. No. 7,213,940. To ensure mixing of light from the white and red LED devices, a large area diffuser is employed that encompasses the array of red and white LED devices. Lamps based on this technology have provided good CRI characteristics, but have not produced spot lighting due to large beam FWHM values, typically of order 100° or higher.

A combination of good color quality, good beam control and uniform illuminance and color in the beam has also been achieved by using a deep (or long) color-mixing cavity that provides multiple reflections of the light, or a long distance between the LED array and the diffuser plate, albeit at the cost of increased light losses due to cavity absorption, and increased lamp size.

It has also been proposed to combine these technologies. For example, Harbers et al., U.S. Publ. Appl. No. 2009/0103296 A1 discloses combining a color-mixing cavity consisting of an array of LED devices mounted on an extended planar substrate that is mounted at the small aperture end of a compound parabolic concentrator. Such designs are calculated to theoretically provide arbitrarily small beam FWHM by using a color-mixing cavity of sufficiently small aperture. For example, in the case of a PAR 38 lamp having a lamp diameter of 120 mm, it is theoretically predicted that a color-mixing cavity of 32 mm diameter coupled with a compound parabolic concentrator could provide a beam FWHM of 30°.

However, as noted in Harbers et al. the compound parabolic concentrator design tends to be tall. This could be problematic for an MR or PAR lamp which has a specified maximum length imposed by the MR/PAR/R regulatory standard to ensure compatibility with existing MR/PAR/R lamp sockets. Harbers et al. also proposed using a truncated compound parabolic concentrator having a truncated length in place of the simulated compound parabolic reflector. However, Harbers et al. indicate that truncation is expected to increase the beam angle. Another approach proposed in Harbers et al. is to design the color-mixing cavity to be partially forward-collimating through the use of a pyramidal or dome-shaped central reflector. However, this approach can compromise color-mixing and hence the CRI characteristics, and also may adversely affect optical coupling with the compound parabolic concentrator, since the number of times that each light ray bounces on the side wall and becomes mixed in color and in spatial distribution is greatly reduced.

BRIEF SUMMARY

In some embodiments disclosed herein as illustrative examples, a directional lamp comprises a light source, a beam forming optical system configured to form light from the light source into a light beam, and a light mixing diffuser arranged to diffuse the light beam. The light source, beam forming optical system, and light mixing diffuser are secured together as a unitary lamp. The beam forming optical system includes: a collecting reflector having an entrance aperture receiving light from the light source and an exit aperture that is larger than the entrance aperture, and a lens disposed at the exit aperture of the collecting reflector, the light source being positioned along an optical axis of the beam forming optical system at a distance from the lens that is within plus or minus ten percent of a focal length of the lens.

In some embodiments disclosed herein as illustrative examples, a directional lamp comprises: a light source; a lens arranged to form light emitted by the light source into a light beam directed along an optical axis, the light source being spaced apart from the lens along the optical axis by a distance that is within plus or minus ten percent of a focal length of the lens; and a reflector arranged to reflect light from the light source that misses the lens into the lens to contribute to the light beam; wherein the light source, lens, and reflector are secured together as a unitary lamp.

In some embodiments disclosed herein as illustrative examples, a lighting apparatus comprises: a light mixing cavity including a planar light source comprising one or more one light emitting diode (LED) devices disposed on a planar reflective surface, a planar light transmissive and light scattering diffuser of maximum lateral dimension L arranged parallel with the planar light source and spaced apart from the planar light source by a spacing S wherein the ratio S/L is less than three, and reflective sidewalls connecting a perimeter of the planar light source and a perimeter of the diffuser.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention.

$$\theta_o \cong \frac{D_s}{D_o}\theta_s$$

assuming that the intensity distribution of the LED array has a FWHM≈120 degrees (i.e. nearly Lambertian).

Figure 29:
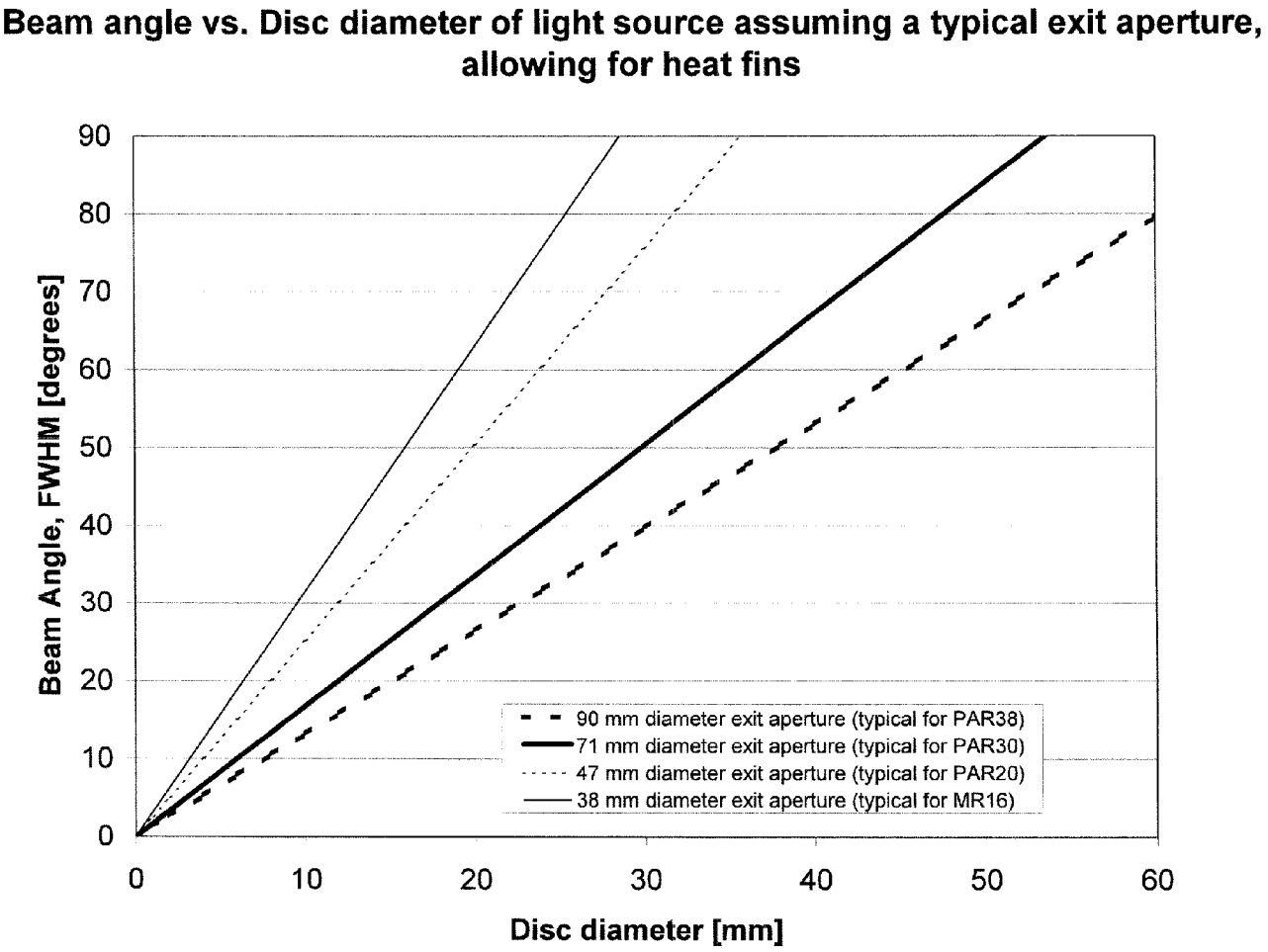

FIG. 29 diagrammatically shows beam angle (FWHM) vs. diameter of the disc light source, for a range of lamp exit apertures 38, 47, 71, and 90 mm corresponding to a typical exit aperture for MR16, PAR20, PAR30, and PAR38 lamps having typical heat fins surrounding the exit aperture, according to the approximate formula:

$$\theta_o \cong \frac{D_s}{D_o}\theta_s$$

assuming that the intensity distribution of the LED array has a FWHM≈120 degrees (i.e. nearly Lambertian), and assuming that the exit aperture diameter is 75% of the maximum possible exit aperture diameter.

Figure 30:
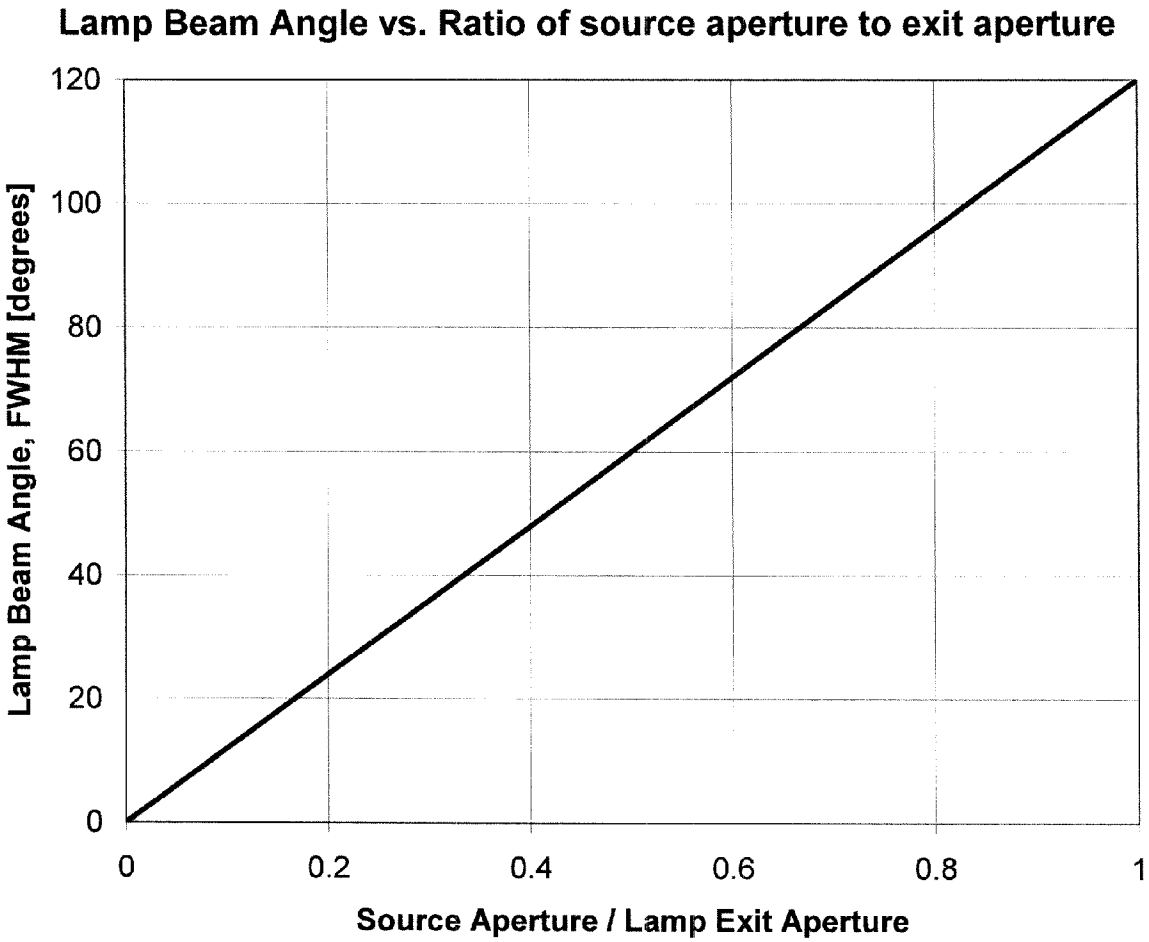

FIG. 30 diagrammatically shows the typical lamp beam angle as a function of the ratio of the light source aperture to the lamp exit aperture, assuming that the light source has nearly a lambertian intensity distribution, characterized by a FWHM of approximately 120 degrees.

Figure 31A:
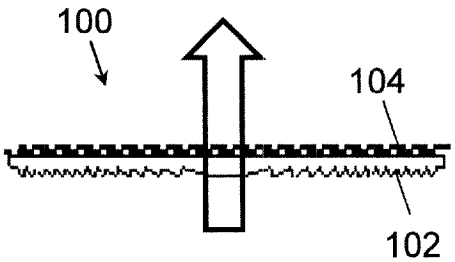
Figure 31B:
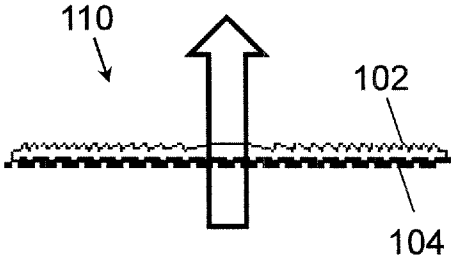

FIGS. 31A and 31B show two embodiments of lenses having a light diffuser formed into a principal surface of the lens.

DETAILED DESCRIPTION OF PREFERRED EMBODIMENTS

Disclosed herein is an approach for designing LED based spot lights, which provides a flexible design paradigm capable of satisfying the myriad design parameters of a family of MR/PAR/R lamps or compact LED modules that enable improved optical and thermal access to the light engine. The spot lights disclosed herein employ a low profile LED-based light source optically coupled with beam forming optics. The low profile LED-based light source typically includes one or more LED devices disposed on a circuit board or other support, optionally disposed inside a low-profile light-mixing cavity. In some embodiments, a light diffuser is disposed at the exit aperture of the light-mixing cavity. In some embodiments the light diffuser is disposed in close proximity to the LED array wherein the low profile LED-based light source is sometimes referred to herein as a pillbox, wherein the circuit board supporting the LED devices is a "bottom" of the pillbox, the light diffuser at the exit aperture is the "top" of the pillbox, and "sides" of the pillbox extend from the periphery of the circuit board to the periphery of the diffuser. To form a light-mixing cavity, the circuit board and sides of the pillbox are preferably light-reflective. Because the pillbox has a low profile, it is approximately disc-shaped, and hence the LED-based light sources employed herein are sometimes also referred to as disc light sources. In other embodiments the diffuser is located elsewhere in the beam path. For example, in some embodiments the diffuser is located outside the beam-forming optics so as to operate on the formed light beam.

This arrangement, coupled with a diffuser designed to operate on a light beam of relatively narrow full-width at half-maximum (FWHM), is disclosed to provide substantial benefits.

A first aspect of this lamp design abandons the approach of modifying an existing optimal beam-forming optics configuration. Rather, the approach disclosed herein is based on first principles of optical design. For example, it is shown herein that an illuminated disc light source can be optimally controlled by beam-forming optics that satisfy a combination of etendue and skew invariants for the disc light source. One such design employs beam-forming optics including a lens (e.g., a Fresnel or convex lens) in which the disc light source is placed at the lens focus so that the disc light source is "imaged" at infinity, coupled with a collecting reflector to capture light rays that would otherwise miss the imaging lens. In some variant embodiments, the disc light source is placed in a slightly defocused position, for example along the beam axis within plus or minus 10% of the focal distance. The defocusing actually produces less perfect beam formation insofar as some light spills outside the beam FWHM—however, for some practical designs such light spillage is aesthetically desirable. The defocusing also produces some light mixing which is advantageous when the light source includes discrete light emitting elements (e.g., LED devices) and/or when these discrete light emitting elements are of different colors or otherwise have different light output characteristics that are advantageously blended. Additionally or alternatively, a light-mixing diffuser may be added to achieve a designed amount of light spillage outside the FWHM and/or a designed amount of light mixing within the beam.

The performance of the light beam can be quantified by several characteristics that are typically measured in the far field (typically considered to be at a distance at least 5-10 times the exit aperture size of the lamp, or typically about one-half meter or further away from the lamp). The following definitions are respective to a beam pattern that is peaked near the center of the beam, on the optical axis of the lamp, with generally reduced intensity moving outward from the optical axis to the edge of the beam and beyond. The first performance characteristic is the maximum beam intensity that is referred to as maximum beam candlepower (MBCP), or since the MBCP is usually found at or near the optical axis, it may also be referred to as center-beam candlepower (CBCP). It measures the perceived brightness of the light at the maximum, or at the center, of the beam pattern. The second is the beam width represented by the full width at half maximum (FWHM), which is the angular width of the beam at an intensity equal to one-half of the maximum intensity in the beam (the MBCP). Related to FWHM is the beam lumens, defined as the integral of the lumens from the center of the beam, outward to the intensity contour having one-half of the maximum intensity, that is, the lumens integrated out to the FWHM of the beam. Further, if the integration of lumens continues outward in the beam to the intensity contour having 10% of the maximum intensity, the integrated lumens may be referred to as the field lumens of the lamp. Finally, if all of the lumens in the beam pattern are integrated, the result is referred to as the face lumens of the lamp, that is, all of the light emanating from the face of the beam-producing lamp. The face lumens are typically about the same as the total lumens, as measured in an integrating sphere, since typically little or no light is emitted from the lamp other than through the output aperture, or face, of the lamp.

Figures 24A, 24B, 24C:
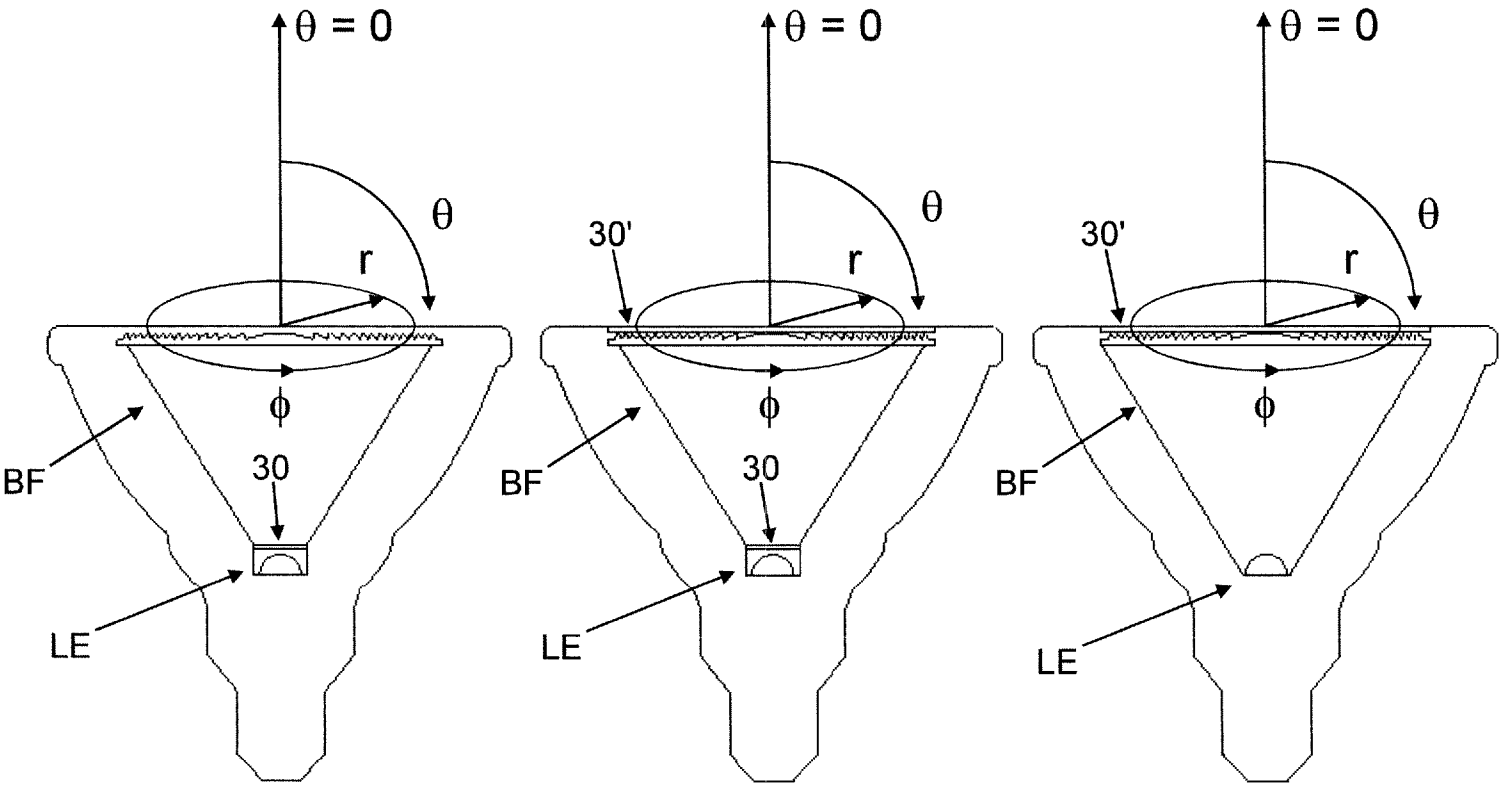
FIG. 24A diagrammatically shows a lamp containing a light engine, beam forming optics including a conical reflector and lens, and an optically diffusing element located adjacent an optically reflective side wall.
FIG. 24B diagrammatically shows a lamp containing a light engine, beam forming optics including a conical reflector and lens, an optically diffusing element located adjacent an optically reflective side wall, and an optically diffusing element located near the output aperture of the MR/PAR/R lamp.
FIG. 24C diagrammatically shows a lamp containing a light engine, beam forming optics including a conical reflector and lens, and an optically diffusing element located near the output aperture of the MR/PAR/R lamp.

Further, the uniformity of the intensity distribution and the color in the beam can be quantified. The following, a conventional cylindrical coordinate system is used to describe the MR/PAR/R lamp, including radial, r, polar angle, θ, and azimuthal angle, ϕ, cylindrical coordinate directions (see the cylindrical coordinate system as depicted in FIGS. 24A, 24B, and 24C, where the lamp includes a light engine LE and beam forming optics BF including a conical reflector and lens). Whereas it is generally preferred in most illumination applications that the intensity of the light in the beam pattern be peaked on axis and to fall in intensity monotonically away from the axis in the polar angle (θ) direction, on the other hand it is generally preferred that there be no intensity variation in the orthogonal (azimuthal angle, or "ϕ") direction, and it is also generally preferred that the color of the light be uniform throughout the beam pattern. The human eye can typically detect intensity non-uniformities exceeding about 20%. So, although the beam intensity decreases in the direction of the polar angle, θ, from 100% on axis (θ=0) to 50% at FWHM, to 10% at the "edge" of the beam, to zero intensity beyond the edge of the beam, the intensity should preferably be contained within a range <+/−20% around the azimuthal (ϕ) direction, at a given polar angle contour in the beam. Additionally, the human eye can typically recognize color differences exceeding about 0.005-0.010 in the 1931 ccx-ccy or the 1976 u'-v' CIE color coordinates, or approximately 100-200 K in CCT for CCT in the range of 2700 to 6000 K. So, the color uniformity throughout the beam pattern should be contained within a range of about Du'v' or Dxy of +/−0.005 to 0.010, or equivalently +/−100 to 200 K, or less, from the average CCT of the beam.

In general, it is desirable to maximize the face lumens (total lumens) of the light in the beam, for a given electrical input to the lamp. The ratio of total face lumens (integrating sphere measurement) to electrical input power to the lamp is the efficacy, in lumens per watt (LPW). To maximize the efficacy of the lamp, it is known (see Non-Imaging Optics, by Roland Winston, et. al., Elsevier Academic Press, 2005, page 11) that the optical parameter known as etendue (also called the "extent" or the "acceptance" or the "Lagrange invariant" or the "optical invariant") should be matched between the light source (such as the filament in the case of an incandescent lamp, or the arc in the case of an arc lamp, or the LED device in the case of an LED-based lamp, or so forth) and the output aperture of the lamp (typically the lens or cover glass attached to the open face of a reflector, or the output face of a refractive, reflective or diffractive beam forming optic). The etendue (E) is defined approximately as the product of the surface area (A) of the aperture through which the light passes (normal to its direction of propagation) times the solid angle (Q) through which the light propagates, $E=A\Omega$. Etendue quantifies how "spread out" the light is in area and angle.

Most conventional light sources can be crudely approximated by a right-circular cylinder having uniform luminance emitted from the surface of the cylinder (for example, an incandescent or halogen filament, or an HID or fluorescent lamp arc, or so forth), and the etendue of the source (the entrance aperture of the optical system) is approximated by $E=A_s\Omega_s$, where $A_s$ is the surface area of the source cylinder ($A_s=\pi RL$, where R=radius, L=length) and Ω is typically a large fraction of 4π (12.56) steradians, typically ~10 sr, meaning that the light is radiated nearly uniformly in all directions. A better approximation may be that the light is radiated with a Lambertian intensity distribution, or the emitted light may be represented by an actually measured spatial and angular 6-dimensional distribution function, but a uniform distribution is illustrative. For example, a typical halogen coil having R=0.7 mm, L=5 mm, and Ω=10 sr has an etendue, $E_s$~100 $mm^2$-sr~1 $cm^2$-sr. Similarly, an HID arc having R=1 mm and L=3.5 mm, also has $E_s$~100 $mm^2$-sr~1 $cm^2$-sr, even though the shapes of the coil and the arc are different, and even though the HID arc may emit several times as many lumens as the halogen coil. The etendue is the "optical extent", or the size of the light source in both the spatial and the angular dimensions. The etendue should not be confused with the "brightness" or "luminance" of the light source—luminance is a different quantitative measure that accounts for both the optical extent of the light source and the quantity of light (lumens).

In the case of the output face of a directional reflector lamp, the exit aperture can be approximated by a circular disc having uniform luminance through it, and the etendue is approximated by $E=A_o\Omega_o$, where $A_o$ is the area of the disc ($\pi R_o^2$, where $R_o$=radius) and Q is typically a small fraction of 2π steradians, characterized by the half-angle of the beam of light, $\theta_o$=FWHM/2=HWHM (half width at half maximum), where $\Omega_o=2\pi(1-\cos(\theta_o))$, e.g., for $\theta_o=90°$, $\Omega_o=2\pi$; for $\theta_o=60°$, $\Omega_o=\pi$; for $\theta_o=30°$, $\Omega_o=0.84$; for $\theta_o=10°$, $\Omega_o=0.10$.

As light propagates through any given optical system, the etendue may only increase or remain constant, hence the term "optical invariant". In a loss-free and scatter-free optical system, the etendue will remain constant, but in any real optical system exhibiting scattering or diffusion of the light, the etendue typical grows larger as the light propagates through the system. The invariance of etendue is an optical analog to conservation of entropy (or randomness) in a thermodynamic system. The statement that E=AΩ cannot be made smaller as light propagates through an optical system, means that in order to reduce the solid angle of the light distribution, the aperture through which the light passes must be increased. Accordingly, the minimum beam angle emitted from a directional lamp having an output aperture, $A_o$, is given by $E_o=A_o\Omega_o=A_s\Omega_s=E_s$. Re-arranging, and substituting $\Omega_o=2\pi(1-\cos(\theta_o))$, yields $$\cos(\theta_o) = 1 - \frac{E_s}{2\pi A_o}.$$

For $\theta_o$<<1 radian (that is, for $\theta_o$<<57°), the cosine function can be approximated by $\cos(\theta_o)\cong 1-\theta^2$, where θ is expressed in radians. Combining the above expressions yields the following output beam half-angle $\theta_o$:

$$\theta_o \cong \sqrt{\frac{\Omega_s A_s}{2\pi A_o}} = \sqrt{\frac{E_s}{2\pi A_o}}. \tag{1}$$

Doubling the half-angle $\theta_o$ of Equation (1) yields the beam FWHM.

In the case of a PAR38 lamp having a circular output aperture, for example, the area of the maximum optical aperture at the face of the lamp is determined by the diameter of the lamp face=4.75"=12 cm, so the maximum allowable $A_o$ is 114 $cm^2$. For the examples of etendue given above for a halogen coil or an HID arc, then the minimum possible half-angle, $\theta_o$, from a PAR38 lamp driven by a light source having $E_s$~1 $cm^2$-sr is $\theta_o$~0.053~3.0°, so the FWHM of the beam would be 6.0°. In practice the narrowest beams available in PAR38 lamps typically have FWHM~6-10°. If the available aperture (i.e. the lens or cover glass) at the face of the lamp is made smaller, then the beam angle will be larger in proportion to the reduction in diameter of the face aperture as per Equation (1).

In the case of a lamp with a circular face aperture of diameter $D_o$ and a light source that is a flat disc of diameter $D_s$, the output half-angle $\theta_o$ of the beam is given by Equation (1) according to:

$$\begin{aligned}\theta_o &\cong \sqrt{\frac{E_s}{2\pi A_o}} \\ &= \sqrt{\frac{\Omega_s A_s}{2\pi A_o}} \\ &= \frac{D_s}{D_o}\sqrt{\frac{\Omega_s}{2\pi}} \\ &= \frac{D_s}{D_o}\sqrt{\frac{2\pi(1-\cos(\theta_s))}{2\pi}} \\ &= \frac{D_s}{D_o}\sqrt{1-\cos\theta_s} \\ &\cong \frac{D_s}{D_o}\theta_s.\end{aligned} \tag{2}$$

In order to provide a narrow spot beam in a lamp using LED devices, or conventional incandescent, halogen, or arc light sources, the light source should have a small etendue. In practice, an LED device comprising a single LED chip typically having a square light-emitting area with linear dimension ~0.5-2.0 mm ($A_s$~0.25-4.0 $mm^2$), an optional encapsulation providing a roughly Lambertian intensity distribution ($\Omega_s$~π), and optional wavelength-converting phosphor, typically have small etendues of about 1-10 $mm^2$-sr, so that a narrow beam can be produced by providing a small, separate beam-forming optic for each LED device. If additional light is required, then additional LED devices, each with a separate optic, may be added. This is a known design approach for achieving narrow beam LED lamps. A problem with this approach is that the light from the individual LED devices is not well-mixed. In commercially available LED PAR/MR lamps, this design methodology typically results in relatively poor color quality (e.g., poor CRI) because the individual LEDs are typically limited to CRI~85 or less. Another problem with this design methodology is that the beam-forming optic typically has only 80-90% efficiency, so that along with other light-coupling losses, the system optical efficiency is typically ~60-80%.

If it is desired to combine the light output of multiple LED devices into a single light beam in order to mix the colors of the individual LED devices into a homogeneous light source having uniform illuminance and color, in order to increase the CRI or some other color quality of the light beam, then a light-mixing LED light engine may be employed. A light-mixing LED light engine typically includes a plurality of LED devices disposed in a light-mixing cavity. By making the light-mixing cavity large and highly reflective, and spacing the LED devices apart within the light-mixing cavity, the light can be made to undergo multiple reflections so as to mix the light from the spaced apart LED devices. A commercially available example of this design methodology is the Cree LLF LR6 down-lighter LED lamp. It provides CRI~92 with FWHM 110°. In addition to the inability to create a spot beam, this design methodology also suffers from optical losses of at least ~5% for each reflection or scattering of the light within the light-mixing chamber. For complete mixing of the color and luminosity of the light, several reflections are employed, so that the system optical efficiency is typically <90%.

The etendue of a light-mixing LED light engine is typically substantially greater than the sum of the etendues of the individual LEDs. The etendue is increased due to the spacing between individual LED emitters that should be sufficient to avoid blocking the light from adjacent LED emitters, and due to light scattering within the light-mixing cavity. For example, if an array of square LED chips, each 1.0×1.0 $mm^2$ is constructed with 1.0 mm spacing between neighboring LED chips, then the effective area occupied by each LED chip increases from 1 $mm^2$ to 4 $mm^2$, and the minimum allowable beam angle of the lamp is increased by a factor of two in accordance with the increase in (effective) $D_s$ in Equation (2). The light mixing provided by the light-mixing cavity also may increase the total etendue of the light engine, since the etendue can only increase or stay the same as the light propagates through an optical system. So, the mixing of the light from individual LEDs into a homogeneous, uniform single light source generally increases the minimum achievable beam angle of the lamp. Based on these observations, it is recognized herein that in order to provide a narrow spot beam from a light-mixing LED light engine including a plurality of LED devices, it is desirable to minimize the area ($A_s$) of the light engine. If a lamp is constructed using a color mixing LED light engine, the etendue of the lamp aperture should also be matched with the etendue of the LED light engine. These design constraints ensure maximizing the efficacy, based on face lumens, of the directional LED lamp employing a color mixing LED light engine.

It is further recognized herein that, to maximize the efficacy of the lamp based on beam lumens, in addition to maximizing the efficacy based on face lumens, for any reflector having rotational symmetry about an optical axis, it is also necessary to match another optical invariant, the rotational skew invariant, of the LED light engine with that of the lamp aperture. The rotational skew invariant, s, is defined for a given light ray by:

$$s=nr_{min}\sin(\gamma) \quad (3),$$

where n is the index of refraction of the medium in which the light ray is propagating, $r_{min}$ is the shortest distance between the light ray and the optical axis of the lamp or of the optical system, and γ is the angle between the light ray and the optical axis (see Non-Imaging Optics, by Roland Winston, et. al., Elsevier Academic Press, 2005, page 237). The invariance of skewness is an optical analog to conservation of angular momentum in a mechanical system. Analogous to a mechanical system wherein both energy and momentum must be conserved and entropy may not decrease in the motion of the mechanical system, in an optical system, conservation of both etendue and rotational skewness are required in any loss-less propagation of light rays through a rotationally symmetric optical system. The skewness of any light ray that passes through the optical axis of the lamp is zero, by virtue of $r_{min}$ being zero in Equation (3). Light rays that pass through the optical axis are known as meridional rays. Light rays that do not pass through the optical axis have non-zero skewness. Such rays, even though they may exit the lamp through the exit aperture at the lens or face plate, may or may not be contained within the beam lumens, depending on how well the skewness of the source (the entrance aperture) is matched to the skewness of the lamp's exit aperture.

Optimal optical efficiency of controlled light (maximizing the efficacy of both the face lumens and beam lumens) through a disc output aperture (such as the output face of a MR/PAR/R lamp) is achievable by using a disc light source, such that both the etendue and the skew invariant of the disc source (entrance aperture) and the lamp exit aperture are matched. With any source geometry other than a disc, simply matching the etendue of the source with the output aperture of the lamp, without regard to skew invariant, as is done in the traditional design of halogen and HID lamps, may direct the maximum possible amount of light through the output aperture, but that fraction of the light that does not simultaneously satisfy the skew invariant will not be included in the controlled portion of the beam, and will be emitted at angles larger than that of the controlled beam. More generally, optimal optical efficiency of controlled light through an output aperture of a given geometry is achievable by using a light source whose light emission area has the same geometry as the output aperture. For example, if the light output aperture has a rectangular geometry of aspect ratio a/b then optimal optical efficiency of controlled light through the rectangular output aperture is achievable by using a light source of rectangular light emission area with aspect ratio a/b. As another example already noted, for a light output aperture that is disc-shaped the optimal optical efficiency of controlled light through the output aperture is achievable by using a light source with a light emission area of disc geometry. As used herein, it is to be understood that the light emission area geometry may be discretized—for example, a disc light source may comprise a light-reflective disc-shaped circuit board with one or more (discrete) LED devices distributed across the disc-shaped circuit board (e.g., see FIGS. 1-15, and FIGS. 16-18 for examples of light sources with discretized light sources defining polygonal or rectangular light emission area geometries).

Thus, it is recognized herein that by satisfying both optical invariants—etendue and skewness—the output beam of the lamp is optimized respective to both total efficacy (face lumens) and beam efficacy (beam lumens). One way to do this is to employ a disc light source and a beam-forming optical system that "images" the disc light source at infinity. More generally, a good approximation to this etendue-and-skew matching condition is achievable for a slightly defocused condition. For example, if the "imaging" beam-forming optical system includes a lens and would provide imaging at infinity by placing the disc light source precisely at the focus of the imaging lens, then a nearly etendue-and-skew matching condition which retains most of the benefits of perfect etendue-and-skew matching is achievable by placement of the disc light source in a defocused position that is close to the focal position of the lens, for example within plus-or-minus 10% of the focal distance.

Due to the skew invariance, it is not possible to achieve the optimal beam efficacy from a rod-shaped light source. Since an incandescent coil or HID arc is an approximately rod-shaped light source, it follows that due to the skew invariance it is not possible to achieve the optimal beam efficacy in an incandescent or HID lamp. In practice, the beam formed from a rod-shaped light source by a finite-length rotationally symmetric optical system typically has a relatively broad distribution of light outside of the FWHM of the beam. The smooth beam edge obtained from incandescent and HID light sources is often desirable, but in many spot-beam applications the edge of the beam cannot be controlled well enough, and too many lumens are wasted in the outer range of the edge of the beam, at the expense of beam lumens and CBCP. In contrast, in the case of a disc-shaped light source having etendue and skewness matched to that of the disc-shaped lamp aperture, it is possible to create a beam having essentially all of the face lumens contained within the beam, so that little or no light falls outside of the beam FWHM. If this abrupt beam pattern is not desirable for a particular application, the beam edge can be smoothed by scattering or redirecting a precisely controlled amount of light out of the beam into the edge of the beam pattern, without wasting lumens in the far edge of the beam pattern. This may be done for example by adding a diffusing or scattering element in the optical path, or by imperfectly imaging (that is, defocusing) the disc light source with the optical system. In this way, both the face lumens and beam lumens can be independently optimized to create exactly the desired beam pattern.

It is recognized herein that skew invariance is a useful design parameter in the case of a two-dimensional light source, for example having a circular or disc aperture. Advantageously, a two-dimensional disc source can be ideally matched to a two-dimensional exit aperture of a reflector lamp, so as to provide maximum efficacy of both the face lumens and the beam lumens. This is because such a lamp geometry can be designed to have entrance and exit apertures with matching skew and etendue invariants, so as to provide an output beam that is optimized respective to both total efficacy (face lumens) and beam efficacy (beam lumens). Some other examples of suitable "disc-shaped" light sources for use in the disclosed directional lamps are disclosed in Aanegola et al., U.S. Pat. No. 7,224,000 which discloses light sources including LED devices on a circuit board and further including a phosphor-coated hemispherical dome covering the LED devices. Such light sources have emission characteristics that are similar to that of an ideal disc (or other extended light emission area) light source, e.g. having a Lambertian emission distribution or other emission distribution with a large emission FWHM angle.

Moreover, the etendue-matching criterion given in Equation (2) and the skewness-matching criterion given in Equation (3) shows that the length of the beam-forming optical train is not a parameter in the optimization. That is, no constraint is imposed on the overall length of the beam-forming optics. Indeed, the only length constraint is the focal length of the optical element that forms the beam, which for a Fresnel or convex lens is typically comparable to the output aperture size. For example, in the case of a PAR38 lamp having a lamp diameter, $D_{PAR}$~120 mm, and an exit aperture $D_o$~80 mm, then an imaging lens such as a Fresnel or convex lens having a focal length, f~80 mm may be chosen. If the imaging lens is placed at the exit aperture of the lamp, at a distance $S_1$ away from the disc light source, then an image of the light source will be formed at a distance $S_2$ behind the lens, given by the lens equation:

$$\frac{1}{f} = \frac{1}{S_1} + \frac{1}{S_2}.$$

For the special case of $f=S_1$, where the distance from the light source to the lens equals the focal length of the lens, then the distance from the lens to the image of the light source created by the lens is $S_2=\infty$. If the light source is a circular disc having uniform luminance and color, then the image at infinity will be a round beam pattern having uniform luminance and color. In practice, the beam pattern at infinity is very nearly the same as the beam pattern in the optical far field, at distances away from the lamp of at least 5 f or 10 f, or in the case of a PAR38 lamp, at least about ½ to 1 meter away or more. If the lens is slightly defocused such that $$\frac{S_1}{f} \cong 0.9 - 1.1$$

then beam pattern at infinity, or in the far field, will be defocused or smoothed such that the luminance at the edge of the beam will be decrease smoothly and monotonically away from the center of the beam, and any discrete non-uniformities in the beam pattern, for example due to the discreteness of the individual LEDs, will be smoothed. The lens may be moved from its focal position to a position closer to the light source, or further from the light source, and the smoothing effect will be similar either way. Moving the lens closer to the light source advantageously enables a more compact lamp. If the lens is defocused by a large amount, e.g.

$$\frac{S_1}{f} < 0.9 \text{ or } \frac{S_1}{f} > 1.1,$$

then a substantial amount of light is cast outside of the FWHM of the beam into the beam edge so that the CBCP is undesirably reduced and FWHM is undesirably increased. The desired slight smoothing of the beam edges and non-uniformities may also be achieved using a weakly scattering diffuser in the optical path, or by combining the effects of a weakly scattering diffuser and a slightly defocused lens.

Still further, if the light-mixing LED light engine serving as the disc source has comparable uniformity in color and illuminance as that desired in the output beam, then no additional mixing of the light is required external to the disc source, so that the beam-forming optics can also have the highest possible efficiency. The beam-forming optics can be constructed using simple optical components such as a conical reflector, Fresnel or simple lens, or so forth.

If the desired uniformity of color and luminance at the disc source can be obtained with a small number of interactions (reflections or transmissions) of the light rays with light-mixing surfaces, and low absorption loss in each interaction, then the optical efficiency of the disc source will also be high (see FIGS. 19-22 and related text herein). That, coupled with high throughput efficiency in the beam-forming optics, results in the high overall optical efficiency of the lamp or illumination device. In a variant approach, if the non-uniformity of color and luminance at the plane of the LEDs can be mixed at the output aperture of the lamp by a high-efficiency, single-pass diffuser, then the overall efficiency of the lamp may be further enhanced significantly. As a result, the light source can be configured to satisfy MR/PAR/R design parameters while simultaneously achieving optimal beam control and optical efficiency for a desired beam FWHM and light exit aperture size. The light mixing may be accomplished in a small disc-shaped enclosure surrounding the LEDs, or in the beam-forming optics, or at a location beyond the beam forming optics (for example, by a single-pass light-mixing diffuser located outside the beam-forming optics). This design approach also enables use of simplified beam-forming optics that enhance manufacturability, such as an illustrative design employing a conical reflector/Fresnel lens combination in which the conical reflector is optionally constructed from a sheet of highly reflective flexible planar reflector material, a coated aluminum sheet, or other reflective sheet.

In some disclosed designs, a light-mixing LED light engine (e.g., FIGS. 19-22) provides mixing of the light from plural LED devices in order to achieve desired color characteristics. In some such embodiments, the disc-shaped light engine includes a diffuser in close proximity to the LEDs to provide most or all of the color mixing. As a result, the depth (or length) of the disc light source can be made small, resulting in a low aspect ratio that readily conforms to geometrical design constraints imposed by the MR/PAR/R standard. In some such embodiments, most light exits the low profile color-mixing chamber with zero or, at most a few, reflections inside the disc chamber, thus making the light engine efficient by reducing light ray interaction (reflection or transmission) losses. In some other embodiments (for example, FIG. 24C), the light exits the plane of the LEDs unmixed, and becomes mixed primarily by the scattering or diffusion of light by a single-pass diffuser within the optical system, but remote from the LEDs, so that most of the light that is backscattered by the diffuser is not returned to the plane of the LEDs in order to reduce the light lost by absorption at the LED plane. Such an embodiment is especially advantageous if the reflectance of the beam forming optic (the conical or shaped reflector) is very high (e.g. >90% or more preferably >95%). It will also be appreciated that the disclosed low profile light-mixing LED light engines such as those shown in FIGS. 19-22 are useful in directional lamps for display and merchandise and residential lighting applications and so forth, but more generally find application anywhere a low profile, uniformly-illuminated disc light source may be useful, such as in undercabinet ambient lighting, general illumination applications, lighting module applications, and so forth, or in any lamp or lighting system where a compact size and weight in combination with good beam control and good color quality are important. In various embodiments disclosed herein, the spatial and angular non-uniformity of the luminous intensity and color is mixed to a sufficient uniform distribution by a single passage of the light through a high efficiency light diffuser such as the Light Shaping Diffuser material produced by Luminit, LLC, having 85-92% transmission of visible light providing diffusion of the transmitted light by 1° to 80° FWHM, depending on the choice of material. In some other embodiments the light diffuser may be in the form of stippling of the surface of the lens or the diffuser, as is used in the design of conventional PAR and MR lamps.

In some disclosed embodiments, the diffusing element is not located proximate to the LED devices, but rather is located outside of the Fresnel lens of the beam-forming optical system. To achieve (possibly slightly defocused) imaging of the disc light source at infinity, the focal point of the Fresnel lens is at or near the LED die plane. To obtain adequate light mixing, a single diffuser that is located only in front of the pillbox should provide heavy diffusion. Even if the pillbox is constructed with low absorptive material, adequate light mixing may involve multiple reflections within the pillbox before the light exits the diffuser which in turn reduces efficiency. As diffusion at the pillbox is decreased, efficiency increases but color mixing decreases. Efficiency can be enhanced when the diffuser is removed from the pillbox, and the collecting reflector of the directional lamp is extended to the LED die level, thus reducing or eliminating the length of the side wall of the pillbox. However, with no diffuser at the exit aperture of the pillbox, the light that is formed into a beam by the beam-forming optical system of the directional lamp is not mixed or only partially mixed. To provide additional light mixing, a light shaping diffuser is suitably located distal from the LED die plane, for example near or beyond the exit aperture of the beam forming optical system. If the diffuser is beyond the exit aperture of the beam-forming optical system, then since the light rays incident on the diffuser are the formed beam which is substantially collimated by the beam-forming optics, the diffuser can be selected to be designed to operate at high efficiency (~92%, or more preferably >95%, or even more preferably >98%) for a collimated beam. The reduced number of reflections along with optimal diffuser efficiency results in significant increase in overall optical efficiency (>90%).

Another aspect of the design of the disclosed directional lamps relates to heat sinking. The optical designs disclosed herein enable: (i) the output aperture of the beam-forming optics to be reduced in size for a given beam angle; and (ii) the length of the lamp including the disc (or other extended light emission area) light source and the beam-forming optics to be substantially reduced while providing well-mixed light. The latter benefit results from the reduction of the length constraint on the beam-forming optics and the low profile of the light source. Because of these benefits, it is possible to surround substantially the entire lamp assembly, including the beam-forming optics, with a heat sink that includes fins surrounding the beam-forming optics, while providing good beam control, high optical efficiency and well-mixed color in the beam. A synergistic benefit of the resulting large heat sink surface area is that the improved heat dissipation enables design of a smaller diameter low-profile disc light source, which in turn enables further reduction in the beam FWHM.

The disclosed designs enable construction of lamps that meet the stringent size, aspect ratio, and beam FWHM constraints of the MR/PAR/R standards, as is demonstrated herein by the reporting of actual reduction to practice of LED-based directional lamps constructed using design techniques disclosed herein. The actually constructed directional lamps both conform with the MR/PAR/R standard and provides excellent CRI characteristics. Moreover, the disclosed design techniques provide principled scaling to larger or smaller lamp sizes and beam widths while still conforming with the MR/PAR/R standard, enabling convenient development of a family of MR/PAR/R lamps of different sizes and beam widths.

Figure 10:
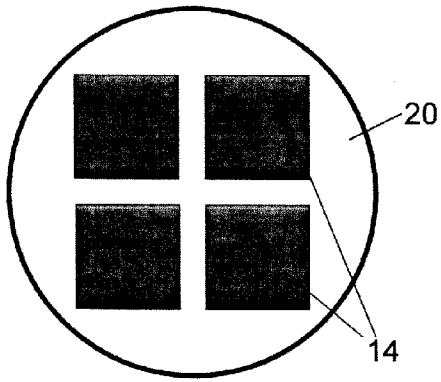
Figure 11:
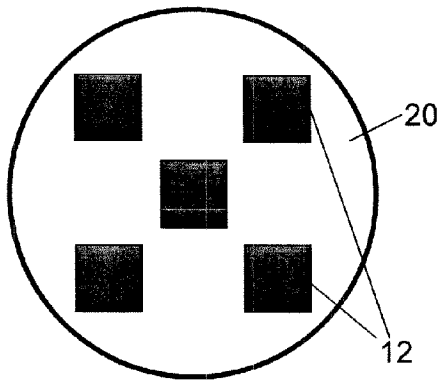
Figure 12:
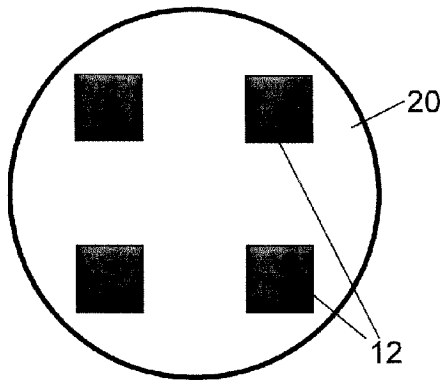
Figure 13:
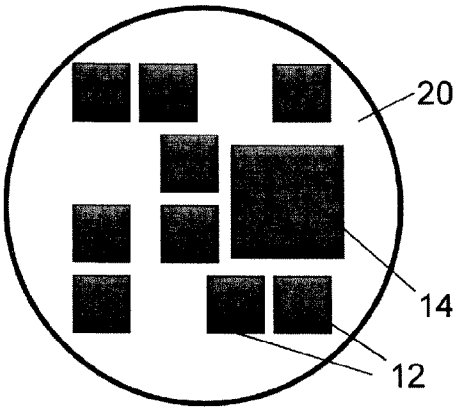
Figure 14:
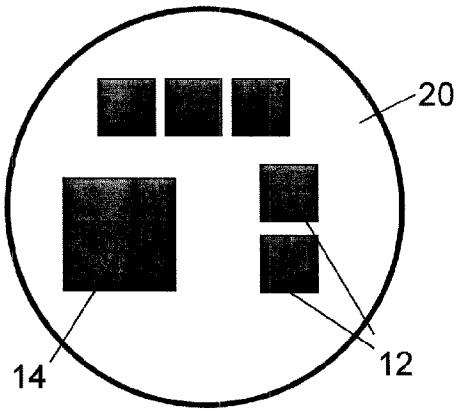
Figure 15:
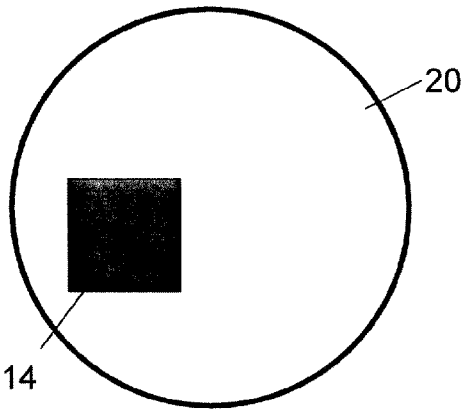

With reference to FIGS. 1-15, some lighting apparatus embodiments disclosed herein employ a light-mixing cavity that includes a planar light source. As shown in FIGS. 1-15, the planar light source includes one or more one light emitting diode (LED) devices 10, 12, 14 disposed on a planar reflective surface 20. The planar reflective surface 20 illustrated in the embodiments of FIGS. 1-15 has a circular perimeter, and may be, for example, a printed circuit board (PCB), metal-core printed circuit board (MC-PCB), or other support. FIGS. 1-9 illustrate various arrangements of small LED devices 10. FIG. 10 illustrates an arrangement of four large LED devices 14. FIGS. 11 and 12 illustrate arrangements of five medium-sized LED devices 12 and four medium-sized LED devices 12, respectively. FIGS. 13 and 14 illustrate arrangements of medium and large LED devices 12, 14. In color mixing embodiments, the different LED devices 12, 14 may be of different types—for example, the medium LED devices 12 may be bluish-green LED devices while the large LED devices 14 may be red LED devices, or vice versa, with the bluish-green and red spectra selected to provide white light when color mixed by a strong diffuser as described herein. Although in FIGS. 13 and 14 the LED devices 12, 14 of different types (e.g., different colors) have different sizes, it is also contemplated for the LED devices of different types to have the same size. As shown in FIG. 15, in yet other embodiments the pattern of one or more LED devices may include as few as a single LED device, such as the illustrated single large LED device shown by way of example in FIG. 15.

Figure 16:
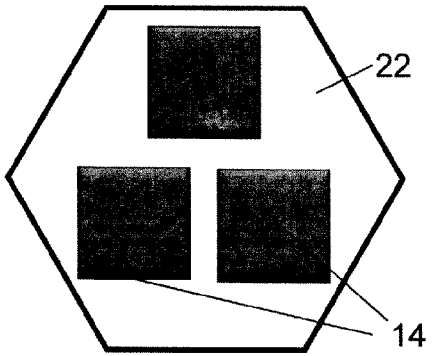
FIGS. 16-18 diagrammatically shows various LED arrays including one or more LEDs on a generally polygonal circuit board, arranged either symmetrically or asymmetrically on the board.
Figure 17:
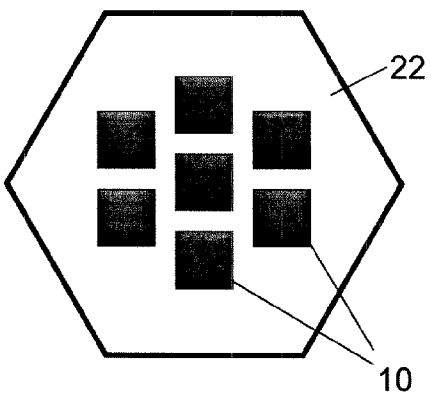
Figure 18:
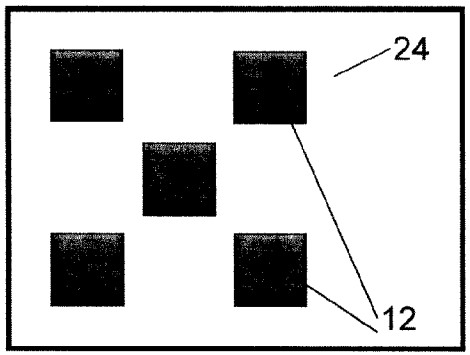

With reference to FIGS. 16-18, in other variant embodiments of the light source, the planar reflective surface has a perimeter other than circular. FIG. 16 illustrates three large LED devices 14 disposed on a planar reflective surface 22 having a polygonal (more particularly hexagonal) perimeter by way of example. FIG. 17 illustrates seven small LED devices 10 disposed on the planar reflective surface 22 with hexagonal perimeter by way of example. FIG. 18 illustrates five medium-sized LED devices 12 disposed on a planar reflective surface 24 having a rectangular perimeter by way of example.

As used herein, the term "LED device" is to be understood to encompass bare semiconductor chips of inorganic or organic LEDs, encapsulated semiconductor chips of inorganic or organic LEDs, LED chip "packages" in which the LED chip is mounted on one or more intermediate elements such as a sub-mount, a lead-frame, a surface mount support, or so forth, semiconductor chips of inorganic or organic LEDs that include a wavelength-converting phosphor coating with or without an encapsulant (for example, an ultraviolet or violet or blue LED chip coated with a yellow, white, amber, green, orange, red, or other phosphor designed to cooperatively produce white light), multi-chip inorganic or organic LED devices (for example, a white LED device including three LED chips emitting red, green, and blue, and possibly other colors of light, respectively, so as to collectively generate white light), or so forth. In the case of color-mixing embodiments, the number of LED devices of each color is selected such that the color-mixed intensity has the desired combined spectrum. By way of example, in FIG. 13 the large LED device 14 may be selected to emit red light and the LED devices 12 may be selected to emit bluish or bluish-greenish or white light, and the selection of nine LED devices 12 and only one LED device 14 may suitably reflect a substantially higher intensity output for the LED device 14 as compared with the LED devices 12 such that the color-mixed output is white light having the desired spectral distribution.

Figure 1:
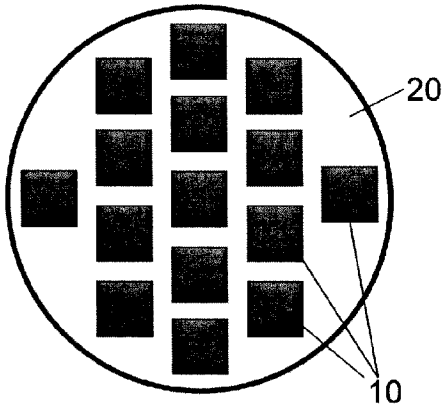
FIGS. 1-15 diagrammatically shows various LED arrays including one or more LEDs on a generally circular circuit board, arranged either symmetrically or asymmetrically on the board.
Figure 2:
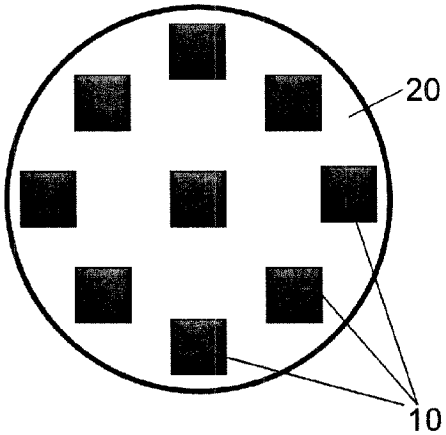
Figure 3:
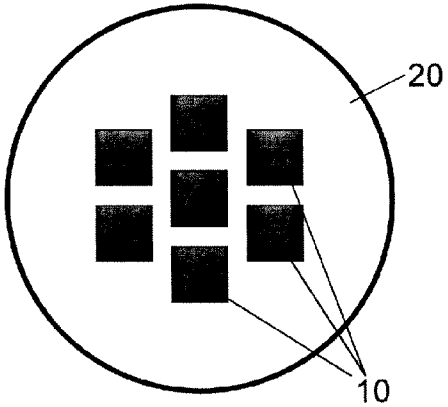
Figure 4:
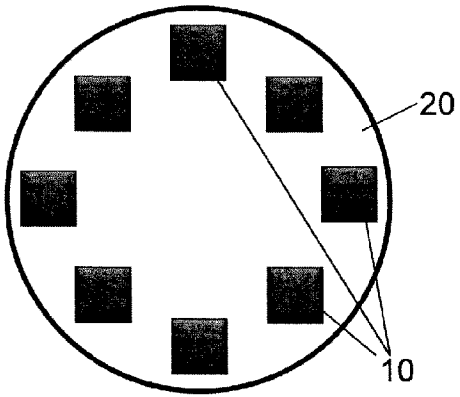
Figure 5:
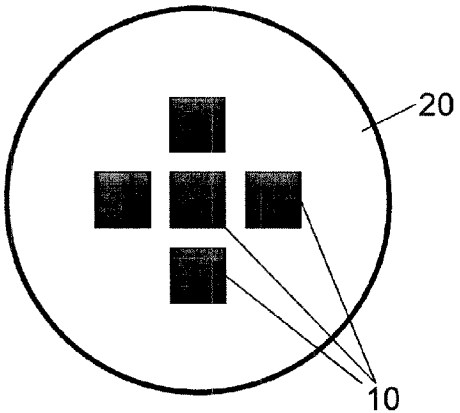
Figure 6:
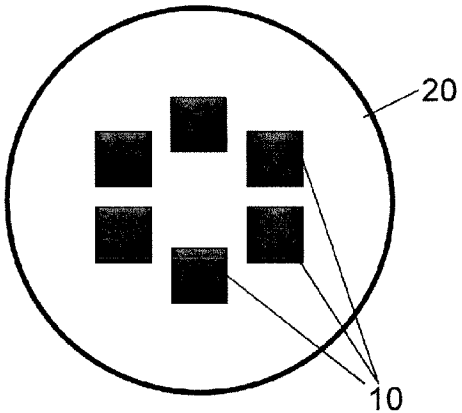
Figure 7:
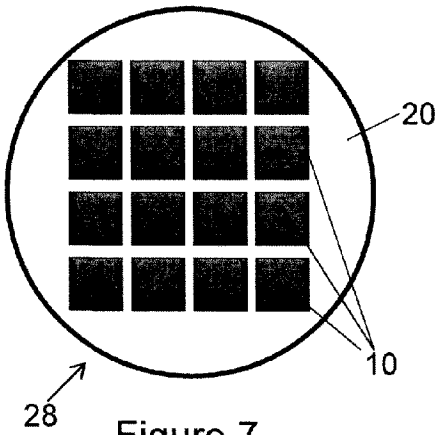
Figure 8:
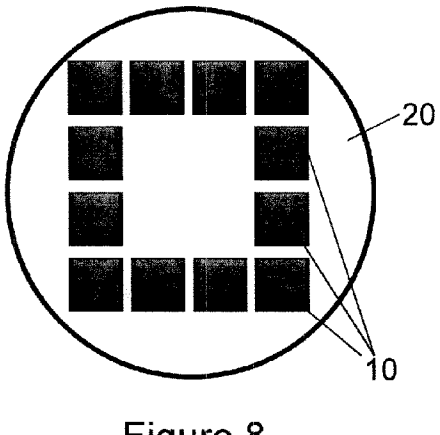
Figure 9:
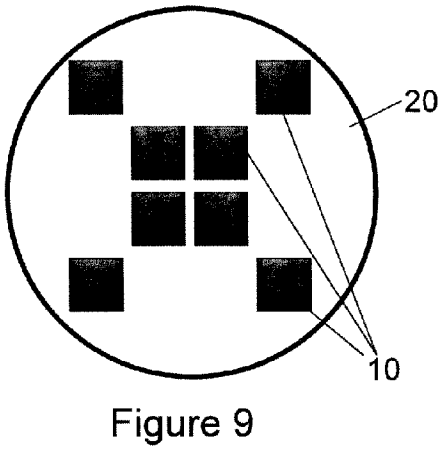
Figure 19:
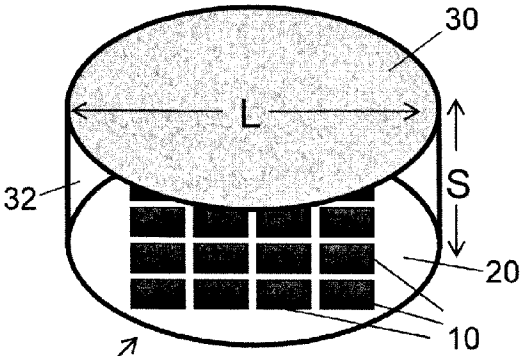
Figure 20:
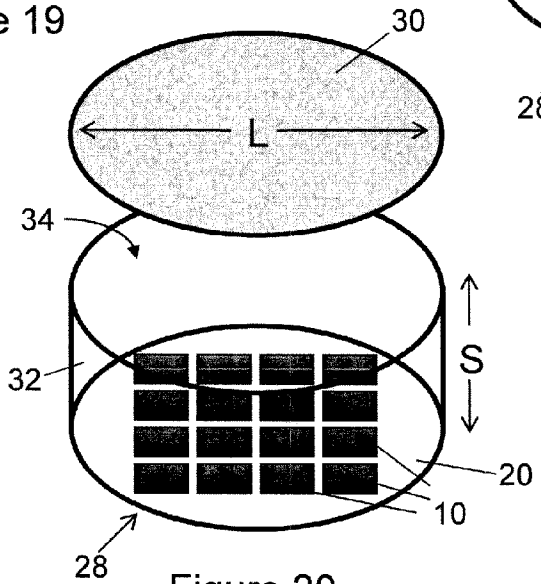

With reference to FIGS. 19 and 20, an illustrative embodiment of a pillbox disc includes a low profile light-mixing cavity in close proximity to the LEDs. A planar light source 28 as shown in FIG. 7 forms the "bottom" of the pillbox, and a planar light transmissive and light scattering diffuser 30 of maximum lateral dimension L is arranged parallel with the planar light source and spaced apart from the planar light source 28 by a spacing S to form the "top" of the pillbox. Reflective sidewalls 32 connecting a perimeter of the planar light source 28 and a perimeter of the diffuser 30. In some embodiments the diffuser 30 is omitted in favor of a diffuser located outside the Fresnel lens or elsewhere as part of the beam-forming optics—in such embodiments, the reflective sidewalls 32 may terminate at and define an entrance aperture for the beam-forming optics, or the reflective sidewall may remain to define the entrance aperture. In FIGS. 19 and 20, the reflective sidewalls 32 are shown in phantom to reveal internal components. Moreover, it is to be understood that it is the inside sidewalls (that is, the sidewalls facing into the light-mixing cavity) that are reflective—the outside sidewalls may or may not be reflective. Thus, a reflective cavity is defined by the reflective surface 20 of the planar light source 28 and the reflective sidewalls 32. This reflective cavity has the diffuser 30 filling its output aperture—in other words, light exits from the reflective cavity via the diffuser 30. FIG. 19 shows the assembled light-mixing cavity including the diffuser 30 disposed over and filling the output aperture of the reflective cavity, while FIG. 20 shows the reflective cavity with the diffuser 30 removed to reveal the output aperture 34 of the reflective cavity.

The illustrative light-mixing cavities employ the planar light source 28 shown in FIG. 7. However, it is to be appreciated that any of the planar light sources shown in any of FIGS. 1-18 may be similarly used in constructing a light-mixing cavity. In the case of the planar light sources of FIGS. 16 and 17, the diffuser optionally has a hexagonal perimeter to match the hexagonal perimeter of the hexagonal reflective surface 22, and the sidewalls suitably have a hexagonal configuration connecting the hexagonal perimeter of the reflective surface 22 with the hexagonal perimeter of the diffuser, or the diffuser and the sidewall may have a circular configuration to match the exit aperture of the lamp. Similarly, in the case of the planar light source of FIG. 18, the diffuser optionally has a rectangular or a square shaped perimeter to match the rectangular or square perimeter of the reflective surface 24, and the sidewalls suitably have a rectangular or square configuration connecting the rectangular or square perimeter of the reflective surface 22 with the rectangular or square perimeter of the diffuser, or the diffuser and the sidewall may have a circular configuration to match the exit aperture of the lamp.

Existing light-mixing cavities (not those illustrated herein) typically rely upon multiple light reflections to achieve light mixing. Toward this end, existing light-mixing cavities employ a substantial separation between the light source and the output aperture such that a light ray makes numerous reflections, on average, before exiting the light-mixing cavity. In some existing light cavities, additional reflective pyramids or other reflective structures may be employed, and/or the output aperture may be made small, so as to increase the number of reflections a light ray undergoes, on average, before exiting via the aperture of the light-mixing cavity. Existing light-mixing cavities are also typically made "long", that is, have the large ratio Dspc/Ap where Dspc is the separation between the light source and the aperture and Ap is the aperture size. A large ratio Dspc/Ap has two effects that are conventionally viewed as beneficial: (i) the large ratio Dspc/Ap promotes multiple reflections and hence increases the light mixing; and (ii) in the case of a spot lamp or other directional lamp the large ratio Dspc/Ap promotes partial collimation of the light by the reflective sidewalls of the light-mixing cavity, and the partial collimation is expected to assist operation of the beam-forming optics. Said another way, a large ratio Dspc/Ap implies a narrow columnar light-mixing cavity having the light source at the "bottom" of the narrow column and the output aperture at the "top" of the narrow column—the narrow reflective column provides partial collimation of light through a large number of reflections.

The light-mixing cavities disclosed herein employ a different approach, in which the diffuser 30 is the primary light-mixing element. Toward this end, the diffuser 30 should be a relatively strong diffuser. For example, in some embodiments, such as a spot lamp, the diffuser has a diffusion angle of at least 5-10 degrees, and in some embodiments, such as a flood lamp, has a diffusion angle of 20-80 degrees. A higher diffusion angle tends to provide better light mixing; however, a higher diffuser angle may also produce stronger backscattering of light back into the optical cavity resulting in greater absorption losses. In the case of a low profile light-mixing cavity, the reflective cavity formed by the reflective surface 20 and the sidewalls 32 is not a substantial contributor to the light mixing. Indeed, there are advantages in having the average number of reflections of a light ray in the reflective cavity be small, e.g. zero, or one, or at most a few reflections on average, since each reflection entails some optical loss due to imperfect reflectivity of the surfaces. Another advantage is that the reflective cavity can be made low-profile, that is, can have a small ratio S/L. Making the ratio S/L small reduces the number of average reflections from the side wall. In some embodiments, the ratio S/L is less than three. In some embodiments, the ratio S/L is less than or about 1.5 (which is estimated to provide an average number of reflections per light ray of between zero and one). In some embodiments, the ratio S/L is less than or about 1.0.

A small number of reflections, such as is achieved by a low-profile reflective cavity with small ratio S/L, reduces or eliminates the partial collimation of the light achieved by a "longer" reflective cavity. Conventionally, this is considered problematic for a spot lamp or other directional lamp.

Figure 21:
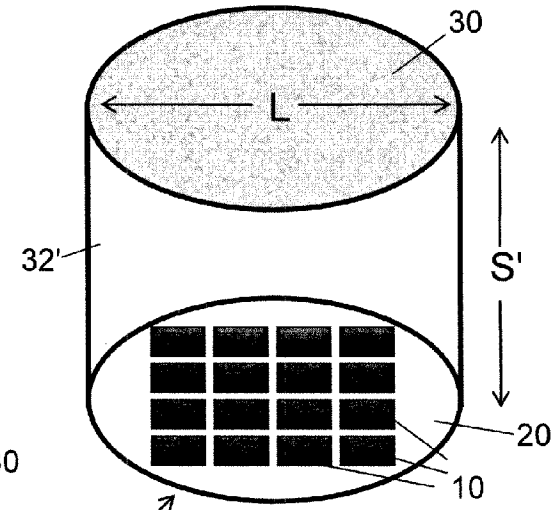
FIGS. 19-22 diagrammatically shows various light engine embodiments each including an array of one or more LEDs on a circuit board, an optically reflective side-wall, and an optically diffusing element.
Figure 22:
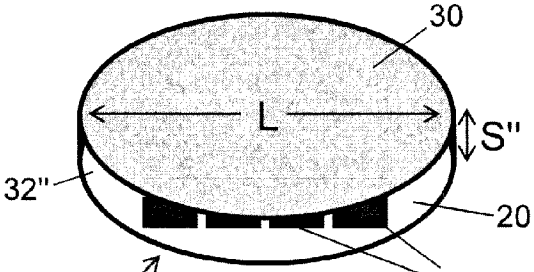

With continuing reference to FIG. 19 and with further reference to FIGS. 21 and 22, three variant light-mixing cavities of the pillbox type are shown. FIG. 19 shows a light-mixing cavity with intermediate ratio S/L. FIG. 21 shows a light-mixing cavity with a larger spacing S' between the diffuser 30 and the planar light source 28, thus leading to a larger ratio S'/L. FIG. 22 shows a light-mixing cavity with a smaller spacing S" between the diffuser 30 and the planar light source 28.

In general, for high optical efficiency from a pillbox-type light-mixing cavity it is desired for S/L<3, and more preferably S/L less than or about 1.5 (typically leading to about 0-1 reflections per light ray, on average), and still more preferably S/L less than or about 1.0. Still smaller values for the ratio S/L are also contemplated, such as is shown in FIG. 22. The minimum value for the ratio S/L is determined by the spatial and angular uniformity of the luminance and color at the output of the light-mixing cavity, which is limited by the spacing of the LED devices and the diffusion angle of the diffuser 30. Advantageously, the angular distribution of luminance generated by the LED devices is typically relatively broad—for example, a typical LED device typically has a Lambertian (i.e., cos(θ)) luminance distribution for which the half-width-at-half-maximum (HWHM) is 60° (i.e., cos(60°)=0.5). For reasonably closely-spaced LED devices such as those illustrated in FIG. 1-14 or 16-18, a diffuser with diffusion angle of about 5-10° or larger is sufficient for providing uniform illumination output from the multiple LED devices across the area of the diffuser 30 without reliance upon multiple light ray reflections within the reflective cavity if S/L is greater than or about 1.0. In the case of the single LED device embodiment of FIG. 15, the minimum value of the ratio S/L is preferably selected to ensure that the single LED device 14 illuminates the whole area of the diffuser 30 so as to generate uniform illumination output across the area of the diffuser 30. If the single LED device emits light having an approximately Lambertian intensity distribution, then S/L greater than or about 1.0 is again sufficient.

The light-mixing cavities disclosed herein with reference to FIGS. 1-22 are suitable for use in any application in which a low profile light source generating uniform illumination across an extended lateral area, substantially without collimation of the output light, is of value. These light-mixing cavities are also useful to provide such a disc light source in which LED devices of different colors or color temperatures (in the case of white LED devices) are color mixed to achieve a desired spectrum, such as white light or white light with a specified color rendering index (CRI), color temperature, or so forth. The light-mixing cavities disclosed herein with reference to FIGS. 1-22 are low profile (that is, have S/L<3, and more preferably S/L less than or about 1.5, and still more preferably S/L less than or about 1.0) and are useful for applications such as undercabinet lighting, theater floor lighting, or so forth, or in any lamp or lighting system where a compact size and weight in combination with good beam control and good color quality are important.

Figure 23:
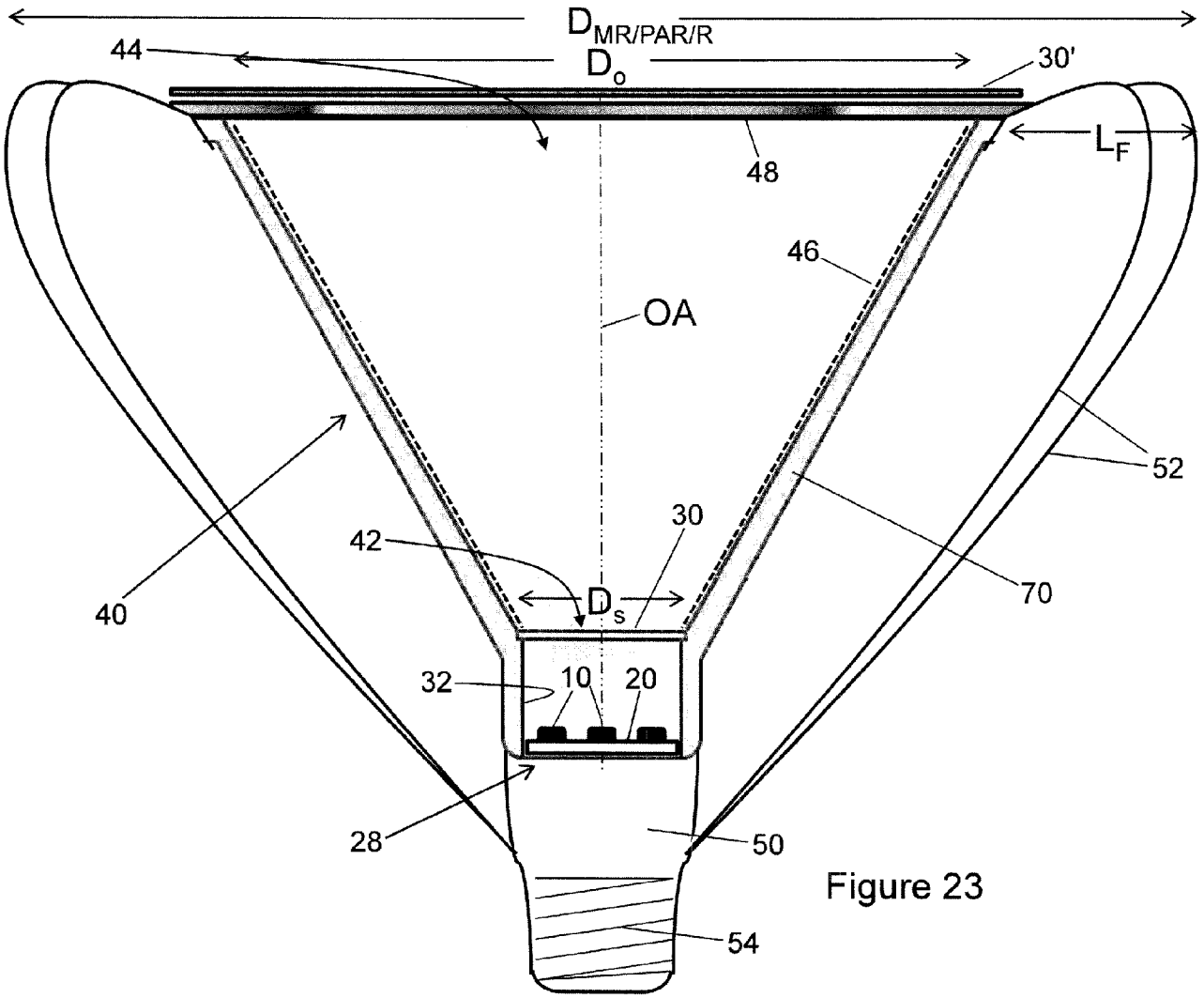
FIG. 23 diagrammatically shows a lamp containing a light engine and beam-forming optics including a conical reflector and lens.

With reference to FIG. 23, the light-mixing cavities disclosed herein with reference to FIGS. 1-22 are suitable for use in a directional lamp. FIG. 23 illustrates a directional lamp including a low profile light-mixing cavity formed by the planar light source 28, the diffuser 30, and connecting reflective sidewalls 32 (i.e., as shown in more detail in FIG. 19) which serves as light input to beam-forming optics 40. The beam forming optics 40 include an entrance aperture 42 which is filled by or defined by the diffuser 30. The entrance aperture 42 has maximum lateral dimension $D_s$ that is approximately the same as the maximum lateral dimension L of the diffuser 30. The beam-forming optics 40 also have an exit aperture 44 that has maximum lateral dimension $D_o$. The illustrative directional lamp of FIG. 23 has rotational symmetry about an optical axis OA, and the apertures 42, 44 have circular perimeters with the circular perimeter of the entrance aperture 42 substantially matching the circular perimeter of the diffuser 30. Accordingly, the maximum lateral dimensions $D_s$, $D_o$, and L are all diameters in this illustrative embodiment. The illustrative beam-forming optics 40 include a conical light-collecting reflector 46 extending from the entrance aperture 42 to the exit aperture 44, and a Fresnel lens 48 (which optionally can be replaced by another type of lens such as a convex lens, holographic lens, or so forth) disposed at the exit aperture 44. More precisely, the conical reflector 46 has the shape of a frustum of a cone, that is, the shape of a cone cut by two parallel planes namely the planes of the entrance and exit apertures 42, 44. Alternately, the conical collecting reflector 46 may be replaced by a parabolic or compound parabolic or other conic section reflector. Due to the nearly ideal disc-shaped light source, the beam can be formed with high efficiency and excellent beam control by imaging the disc light source into the optical far field using a Fresnel or other lens at the output aperture of the lamp. To achieve imaging of the disc light source at infinity the disc light source should be located at the focus of the imaging lens 48. Such an arrangement forms a beam that contains all of the face lumens within the beam lumens in an ideal situation, or nearly all of the face lumens within the beam lumens in a practical lamp, providing a beam pattern with abrupt edges. If, instead, the arrangement is slightly defocused, for example with the disc light source located at a distance from the imaging lens 48 that is within plus or minus 10% of the lens focal length but not precisely at the lens focal length, then the defocusing produces a light beam that still has a narrow FWHM but in which intensity edges are smoothed or eliminated. Due to the nearly Lambertian angular intensity distribution of the LEDs, most of the light reaches the lamp aperture without reflection from the conical reflector, so that the primary purpose of the reflector is to gather the small amount of light from the high angles (in other words, is arranged to reflect light from the light source that misses the lens 48 into the lens 48 to contribute to the light beam). In some embodiments, the exit aperture of the collecting reflector is at least three times larger than the entrance aperture of the collecting reflector. In some embodiments, the exit aperture of the collecting reflector is at least five times larger than the entrance aperture of the collecting reflector. In some embodiments, the exit aperture of the collecting reflector is at least eight times larger than the entrance aperture of the collecting reflector. In contrast, the primary purpose of the reflector in conventional beam-forming optics is to create the beam pattern. Since the primary purpose of the reflector 46 of FIG. 23 is to gather high-angle light, rather than providing the primary control of the beam shape, the traditional parabola or CPC may be replaced by a less complex design such as the illustrative conical reflector 46, with a significant advantage that the cone may be constructed from a variety of flat, inexpensive, coated materials having extremely high optical reflectivity (90% or higher).

As used herein, the "beam-forming optics" or "beam-forming optical system" includes one or more optical elements configured to transform the illumination output from the entrance aperture 42 into a beam with specified characteristics, such as a specified beam width represented by the full width at half maximum (FWHM) of the beam, a specified beam lumens which is the integral of the lumens over the beam within the FWHM, a specified minimum CBCP, or so forth.

The directional lamp of FIG. 23 further includes heat sinking. To obtain a high intensity light beam, the LED devices 10 should be high power LED devices, which typically include LED chips driven at high current of order 100 to 1000 mA, or higher, per LED chip. Although LEDs generally have very high luminous efficacy of about 75 to 150 LPW (i.e., lumens per watt), this is still only about one-fourth to one-half of the efficacy of an ideal light source, which would provide about 300 LPW. Any power supplied to the LED that is not radiated as light is dissipated from the LED as heat. As a consequence, a substantial amount of heat, typically one-half to three-quarters of the power supplied to each LED, is generated at the planar light source 28. Moreover, LED devices are highly temperature-sensitive as compared with incandescent or halogen filaments, and the operating temperature of the LED devices 10 should be limited to around 100-150° C., or preferably lower. Still further, this low operating temperature in turn reduces the effectiveness of radiative and convective cooling. To provide sufficient radiative and convective cooling to meet these stringent operating temperature parameters, it is recognized herein that heat sinking disposed solely around the planar light source 28 is likely to be insufficient. Accordingly, as shown in FIG. 23, the heat sinking includes a main heat sinking body 50 disposed proximate to (i.e., "underneath") the planar light source 28, and heat sinking fins 52 (which are optionally replaced by heat sinking rods or other structures with large surface area) which extend radially outside of the beam-forming optics 40. Even if active cooling in form of a fan, a blower, or a phase-changing liquid is used to enhance the removal of heat from the LEDs, the amount of heat removal is still usually proportional to the available surface area of the heat transfer device surrounding the LEDs, so that providing for a large heat transfer area is generally desirable.

The illustrated directional lamp of FIG. 23 is of an MR/PAR/R design, and toward this end includes a threaded Edison base 54 designed to mechanically and electrically connect with a mating Edison-type receptacle. Alternatively, the base can be a bayonet-type base or other standard base chosen to comport with the receptacle of choice. Insofar as the MR/PAR/R standard imposes an upper limit on the lamp diameter $D_{MR/PAR/R}$, it will be appreciated that there is a trade-off between the lateral extent $L_F$ of the heat-sinking fins 52, on the one hand, and the diameter $D_o$ of the optical exit aperture 44 on the other hand.

The directional lamps disclosed herein are constructed based on Equations (2) and (3), so as to match the etendue and skew invariants for the entrance and exit apertures 42, 44. Said another way, the directional lamps disclosed herein are constructed based on Equations (2) and (3) so as to match the etendue and skew invariants for (i) the source light distribution output by the entrance aperture 42 and (ii) the light beam intended to emanate out of the exit aperture 44.

Considering first the etendue invariance, Equation (2) includes four parameters: output half-angle $\theta_o$ of the beam (which is one-half the desired FWHM angle); half-angle $\theta_s$ of the light distribution at the entrance aperture 42; and the entrance and exit aperture diameters $D_s$, $D_o$. Of these, the output half-angle $\theta_o$ of the beam is a target beam half-angle that the directional lamp is to produce, and so it can be considered to be the result of the other 3 parameters. Exit aperture $D_o$ should be made as small as practicable in order to maximize the lateral extent $L_F$ of the heat-sinking fins 52 to promote efficient cooling. The half-angle $\theta_s$ of the light distribution at the entrance aperture 42 is typically about 60° (corresponding to approximately a Lambertian intensity distribution), so that the most influential design parameters for the optical system are the entrance aperture diameter $D_s$ which, together with $\theta_s$, determines the source etendue, and exit aperture diameter $D_o$. For a narrow beam angle, the source etendue should be made as small as possible, that is, $D_s$ and $\theta_s$ should be minimized, and the exit aperture diameter $D_o$ should be maximized. However, these design parameters are to be optimized under constraints including: the maximum aperture diameter $D_o$ imposed by the MR/PAR/R diameter standard $D_{MR/PAR/R}$; the heat sinking for the thermal load of LED devices 10 sufficient to generate the desired light beam intensity which imposes a minimum value on the fins lateral extent $L_F$; a minimum value constraint for the entrance aperture diameter $D_s$ imposed by thermal, mechanical, electrical, and optical limits on how closely the LED devices 10 can be spaced on the planar reflective surface 20; and a lower limit on the source half-angle $\theta_s$ imposed by the low-profile light-mixing source which does not provide partial collimation by multiple reflections, or by the LED intensity distribution itself.

Turning to the skew invariance, the use of a disc light source (that is, a light source having a disc-shaped light emission area, optionally discretized into one or more individual LED devices disposed on a reflective circuit board or other support) enables exact matching of skew invariance with that of the exit aperture 44, which provides the possibility of containing all of the face lumens within the beam lumens in an ideal situation, or nearly all of the face lumens within the beam lumens in a practical lamp, providing the possibility of an extremely abrupt edge of the beam pattern. The Fresnel lens 48 (or convex lens, holographic lens, compound lens, or so forth) filling the exit aperture and cooperating with the conical reflector 46 (or other collecting reflector) may be used to generate an image in the optical far field of the illumination output at the entrance aperture 42 to produce a beam pattern with a sharp cut-off at the edge of the beam. Alternately, the Fresnel lens (or convex lens, holographic lens, compound lens, or so forth) cooperating with the conical reflector 46 (or other collecting reflector) may be used to generate an image of the illumination output at the entrance aperture 42 that is de-focused in the far field to produce a beam pattern with a gradual cut-off at the edge of the beam. A de-focused placement of the Fresnel lens 48 may also be used to supplement the light mixing that is provided predominantly by the diffuser, since the images of the discrete LED light sources are thus out of focus in the far field such that the interstitial spaces between the LEDs appear in the far-field beam pattern to be filled in by the light from adjacent LEDs.

It will be noted that the design considerations do not include any limitation on the "height" or "length" of the lamp along the optical axis OA. (The optical axis OA is defined by the beam forming optical system, and more particularly by the optical axis of the imaging lens 48 in the embodiment of FIG. 23). The only limitation imposed on the height or length is by the focal length of the lens 48, which can be small for a Fresnel lens or a short-focal length convex lens. In some embodiments, the lens has an f-number N=f/D of less than or about one where N is the f-number, f is the focal length of the lens, and D is a maximum dimension of the entrance pupil of the lens. Moreover, there is no limitation imposed on the shape of the reflector 46—for example, the illustrated conical reflector 46 could be replaced by a parabolic concentrator, a compound parabolic concentrator, or so forth.

With continuing reference to FIG. 23, in some embodiments a diffuser 30' is disposed outside the Fresnel lens 48, that is, such that light from the pillbox passes through the Fresnel lens 48 to reach the diffuser 30'. As noted previously, if the diffuser 30 at the entrance aperture 42 (that is, at the "top" of the pillbox) is employed alone, then heavy diffusion is typically employed to achieve adequate light mixing. However, this can lead to back-reflections off the diffuser 30 and consequent increased light losses. Adding the diffuser 30' located outside of the Fresnel lens 48 can provide additional light mixing, enabling the diffusion strength of the diffuser 30 at the entrance aperture 42 to be reduced, or the diffuser 30' may provide all of the required light mixing so that the diffuser 30 at the entrance aperture 42 may be eliminated. For the diffuser 30' located outside the Fresnel lens 48, the incident light rays are nearly collimated, and so the diffuser 30' can be selected to be a diffuser designed to operate at high efficiency (~92%, and more preferably >95%, and still more preferably >98%) for collimated input light. For example, in some embodiments employing only the diffuser 30', but not the diffuser 30, the spatial and angular non-uniformity of the luminous intensity and color is mixed to a substantially uniform distribution by the diffuser 30' which is a single-pass light diffuser. Some suitable single-pass light diffusers designed to provide a selected output (diffused) light scattering distribution FWHM include Light Shaping Diffuser® material produced by Luminit, LLC, having 85-92% transmission of visible light and providing diffusion of the transmitted light with a light scattering distribution (for collimated input light) of between 1° and 80° FWHM, depending on the choice of material. Another suitable diffuser material is ACEL™ light diffusing material (available from Bright View Technologies). These illustrative designed single-pass diffuser materials are not bulk diffusers in which light scattering particles are dispersed in a light-transmissive binder, but rather are interface diffusers in which the light diffusion occurs at an engineered interface having light scattering and/or refractive microstructures engineered to provide the target light scattering distribution for input collimated light. Such diffusers are well suited for use as the diffuser 30' that passes the light beam of relatively small FWHM. (In contrast, light rays incident on such a designed diffuser that are not nearly collimated would be more likely to be scattered into higher angles than desired). In other words, there is a synergistic benefit to (i) placing the diffuser 30' after the imaging lens 48 so as to receive an input light beam of relatively small FWHM and (ii) using an engineered interface diffuser or other single-pass diffuser which advantageously has low backreflection. The reduced number of reflections along with optimal diffuser efficiency provided by the diffuser 30' located beyond the beam-forming optics and engineered to provide a designed light scattering distribution FWHM results in significant increase in overall optical efficiency (>90%). In some embodiments, the diffuser 30 is included while the diffuser 30' is omitted. In some embodiments, both diffusers 30, 30' are included.

In yet other embodiments, the diffuser 30 at the entrance aperture 42 is omitted and the diffuser 30' outside the Fresnel lens 48 is included. In these embodiments in which the diffuser 30 is omitted, the cone of the reflector 46 is optionally extended to the LED die level—that is, the planar light source 28 is optionally arranged coincident with the entrance aperture 42, and the reflective sidewalls 32 are optionally omitted along with the omitting of the diffuser 30. In such embodiments, the diffuser 30' is relied upon to provide the light mixing. In any of the embodiments, the lens may also be defocused to provide additional light mixing.

These various arrangements are further shown in FIGS. 24A, 24B, and 24C. FIG. 24A diagrammatically shows a lamp containing a light engine LE, beam forming optics BF including a conical reflector and lens, and the optically diffusing element 30 located adjacent an optically reflective side wall. In this embodiment the optically diffusing element 30 is a heavy diffuser, and there is no diffuser at the output aperture. FIG. 24B diagrammatically shows a lamp containing the light engine LE, beam forming optics BF including a conical reflector and lens, and both (i) the optically diffusing element 30 located adjacent an optically reflective side wall and (ii) and the optically diffusing element 30' located near the output aperture of the MR/PAR/R lamp. In this embodiment the optically diffusing element 30 is a soft diffuser, as further diffusion is provided by the light shaping diffuser 30' at the output aperture of the lamp. FIG. 24C diagrammatically shows a lamp containing the light engine LE, beam forming optics BF including a conical reflector and lens, and the light shaping optically diffusing element 30' located near the output aperture of the MR/PAR/R lamp. In the embodiment of FIG. 24C the light diffusing element 30 is omitted.

Figure 26:
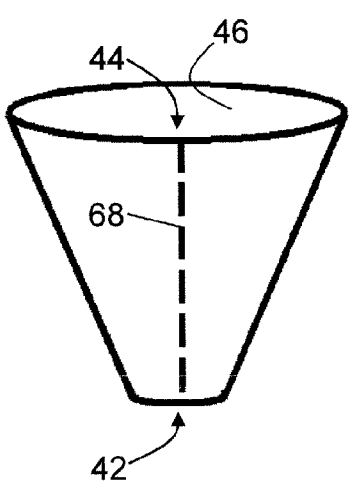
FIGS. 25, 26, and 27 illustrate one approach for constructing the conical reflector of FIG. 23.
Figure 27:
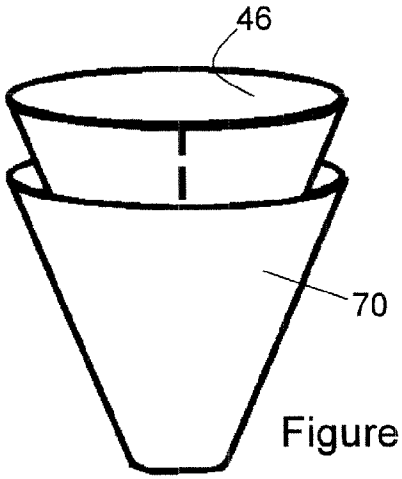
Figure 25:
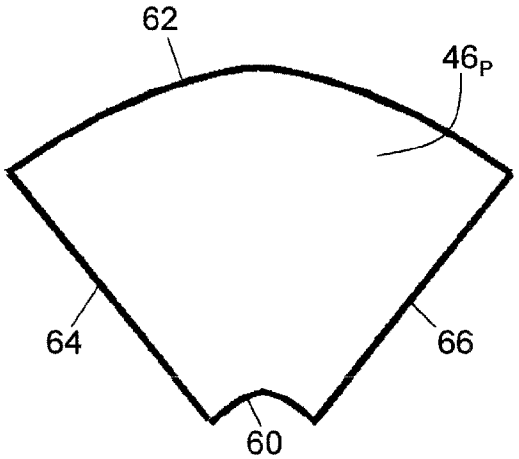

With reference to FIGS. 25-27, an advantage of the illustrated conical reflector 46 is that it can simplify manufacturing, reduce cost, and improve efficiency. For example, FIGS. 25-27 illustrate how the conical reflector 46 can be a planar reflective sheet covering an inside conical surface of a conical former. FIG. 25 shows a planar reflective sheet $\mathbf{46}_P$ having rounded lower and upper edges 60, 62 corresponding to the entrance and exit apertures 42, 44, respectively, and side edges 64, 66. As shown in FIG. 26, the planar reflective sheet $\mathbf{46}_P$ can be rolled to form the conical reflector 46, with the side edges 64, 66 joined at a connection 68 (which optionally may include some overlap of the side edges 64, 66), which then may be inserted into a conical former 70 as illustrated in FIG. 27. With reference back to FIG. 23, the conical former 70 may, for example, be a conical heat-sinking structure 70 that also supports the heat-sinking fins 52. In addition to the simplification and cost-reduction in manufacturing, the conical reflector also enables the use of coated reflector materials having extremely high optical reflectivity in the visible, such as a coated aluminum material named Miro produced by ALANOD Aluminium-Veredlung GmbH & Co. KG having about 92-98% visible reflectance; or polymer film named Vikuiti produced by 3M having about 97-98% visible reflectance.

Figure 28:
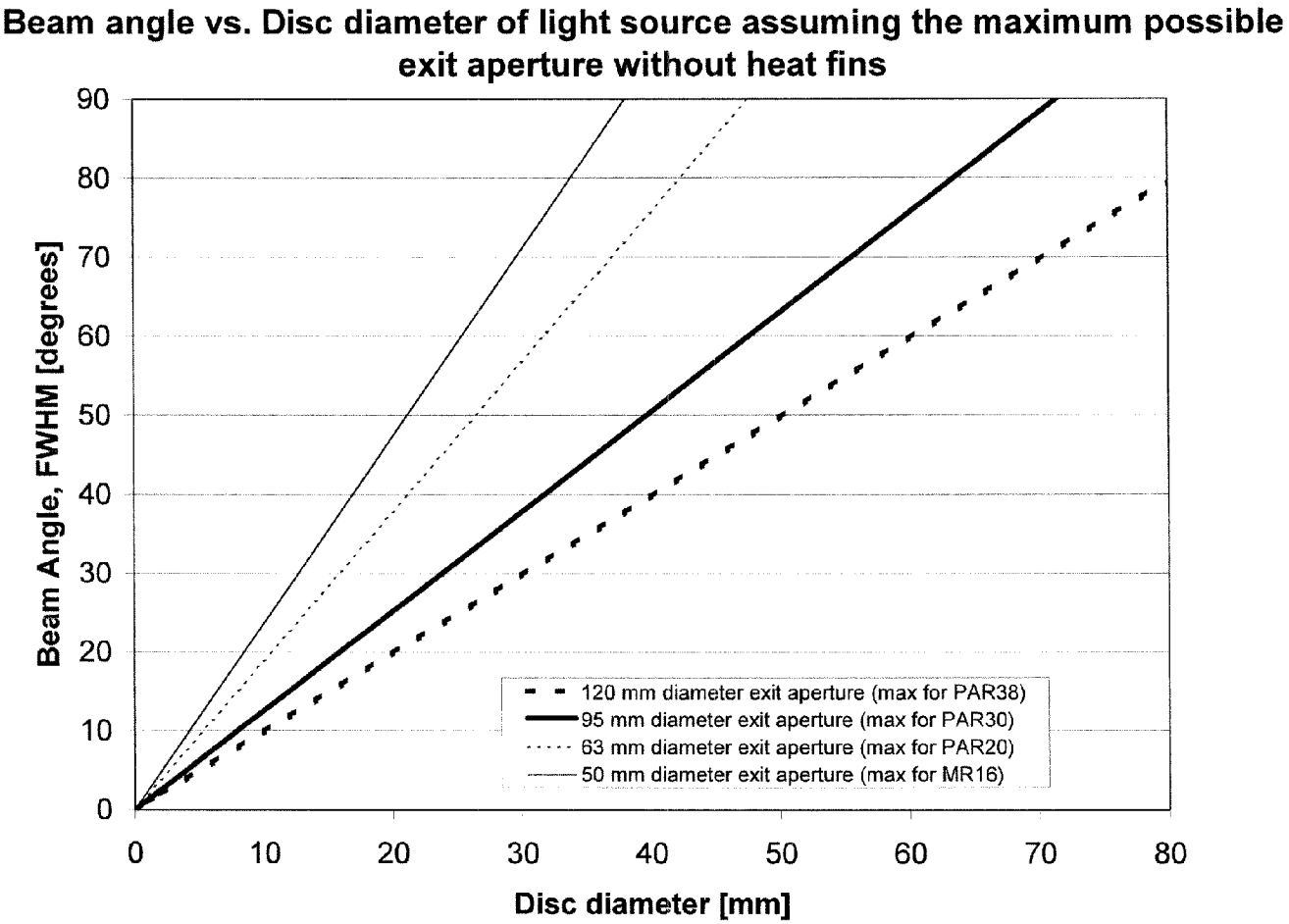
FIG. 28 diagrammatically shows beam angle (FWHM) versus diameter of the disc light source, for a range of lamp exit apertures 50, 63, 95, and 120 mm corresponding to the maximum possible exit aperture for MR16, PAR20, PAR30, and PAR38 lamps having no heat fins, according to the approximate formula.

FIGS. 28 and 29 illustrate computed values for the FWHM angle of the beam pattern in degrees (on the ordinate axis) versus the entrance aperture diameter $D_s$ for various MR/PAR/R lamp designs (on the abscissa axis). In FIG. 28, it is assumed that the exit aperture of the lamp has the maximum possible value equal to the diameter of the lamp envelope itself, $D_o=D_{MR/PAR/R}$, e.g. $D_o$=120 mm for a PAR38 lamp; while in FIG. 29, it is assumed that the exit aperture of the lamp is only 75% of the maximum possible value, e.g. $D_o$=90 mm for a PAR38, in order to allow an annular space for heat sinking fins 52 (see FIG. 23), or other high-surface area structures for promoting heat removal by radiation and convection, around the beam-forming optics 40. In FIGS. 28 and 29 plots are shown for MR16, PAR20, PAR30, and PAR38, where the numbers indicate the MR/PAR/R lamp diameter in eights of an inch (thus, MR16 has a 16/8=2 inch diameter, for example). The plots assume $2\times\theta_s=120°$, corresponding to a Lambertian intensity distribution for the LED array.

FIG. 30 plots the beam output angle FWHM (that is, $2\times\theta_o$) as the ordinate versus the ratio $D_s/D_o$ (or, equivalently, $L/D_o$) as the abscissa. This plot also assumes $2\times\theta_s=120°$, corresponding to a Lambertian intensity distribution for the LED array.

With reference to FIGS. 31A and 31B, in some embodiments the Fresnel lens 48 and the diffuser 30' located at the exit aperture of the collecting reflector 46 are combined in a single optical element. In FIG. 31A, an optical element 100 includes a lensing side 102 that is the light-input side and is engineered by laser etching or another patterning technique to define a Fresnel lens suitably serving as the Fresnel lens 48, and also includes a light diffusing side 104 that is the light exit side and is engineered by laser etching or another patterning technique to define a single-pass interface diffuser suitably serving as the light-mixing diffuser 30'. Said another way, the light mixing diffuser comprises an interface diffuser 104 formed into a principal surface of the lens 100 of the beam forming optical system. In the configuration of FIG. 31A, the diffusing side 104 advantageously passes light after it is formed into a beam by the lensing side 102. Alternatively, as shown in FIG. 31B an optical element 110 has the same structure as the optical element 100, but the light diffusing side 104 is arranged as the light input side and the lensing side 102 is arranged as the light exit side.

The preferred embodiments have been illustrated and described. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A directional lamp comprising:

a planar light source comprising one or more light emitting diode (LED) devices defining an LED plane; and a beam forming optical system configured to form light from the planar light source into a light beam, the optical system including:

a collecting reflector having an entrance aperture of diameter $D_s$ receiving light from the light source and an exit aperture of diameter $D_o$ that is larger than the diameter $D_s$ of the entrance aperture, and a collimating lens disposed at the exit aperture of the collecting reflector; and wherein the light source and beam forming optical system are secured together as a unitary lamp.

2. The directional lamp as set forth in claim 1, further comprising a light-mixing diffuser arranged to diffuse the light beam wherein the light mixing diffuser comprises a single-pass diffuser having less than 10% back-reflection for the light beam.

3. The directional lamp as set forth in claim 2, wherein the single-pass diffuser comprises an interlace diffuser.

4. The directional lamp as set forth in claim 2, wherein the single-pass diffuser scatters collimated input light into an angular distribution having a full width at half maximum (FWHM) of less than or about 40°.

5. The directional lamp as set forth in claim 1, further comprising a light-mixing diffuser arranged to diffuse the light beam wherein the light mixing diffuser comprises an interface diffuser formed into a principal surface of the collimating lens of the beam forming optical system.

6. The directional lamp as set forth in claim 1, further comprising a light-mixing diffuser arranged to diffuse the light beam wherein the light mixing diffuser is disposed to receive light from the light source after passing through the collimating lens.

7. The directional lamp as set forth in claim 1, wherein the planar light source is positioned along an optical axis of the beam forming optical system with the LED plane at a distance from the collimating lens that is within plus or minus ten percent of a focal length of the collimating lens.

8. The directional lamp as set forth in claim 1, wherein the one or more LED devices include LED devices of at least two different colors, and the directional lamp further comprises a light mixing diffuser arranged to diffuse the light beam to reduce the variation of chromaticity within the FWHM beam angle to within 0.006 from the weighted average point on the CIE 1976 u'v' color space diagram.

9. The directional lamp as set forth in claim 1, wherein $\theta_s$ is the half-angle of light emission of the planar light source, $\theta_o$ is the half-angle of light emission of the directional lamp, and $$D_o \geq \frac{\theta_s}{\theta_o} D_s \text{ and } D_s \leq \frac{\theta_o}{\theta_s} D_o.$$

10. The directional lamp as set forth in claim 9, wherein:

the light source is positioned along the optical axis of the beam forming optical system at a defocused position respective to the collimating lens to produce defocusing, and the directional lamp further comprises a light mixing diffuser arranged to diffuse the light beam, wherein diffusion of the light beam provided by the light mixing diffuser together with the defocusing transforms a spatial intensity distribution of the light beam having multiple intensity peaks due to the plurality of spatially discrete light emitting elements into a light beam having no visually perceptible local variations of intensity throughout the beam pattern.

11. The directional lamp as set forth in claim 1, further comprising:

a first diffuser disposed with the planar light source at the entrance aperture of the collecting reflector; and a second diffuser disposed with the collimating lens at the exit aperture of the collecting reflector.

12. The directional lamp as set forth in claim 1, wherein $\theta_s$ is the half-angle of light emission of the planar light source, $\theta_o$ is the half-angle of light emission of the directional lamp, and $$D_o \geq \frac{\theta_s}{\theta_o} D_s \text{ and } D_s \leq \frac{\theta_o}{\theta_s} D_o,$$

and the planar light source is positioned along an optical axis of the beam forming optical system with the LED plane at a distance from the collimating lens that is within plus or minus ten percent of a focal length of the collimating lens.

13. The directional lamp as set forth in claim 1, wherein the collimating lens has an f-number N=f/D of less than or about one where f is the focal length of the collimating lens and D is a maximum dimension of the entrance pupil of the collimating lens.

14. The directional lamp as set forth in claim 13, wherein the planar light source is positioned along an optical axis of the beam forming optical system with the LED plane at a distance from the collimating lens that is within plus or minus ten percent of a focal length of the collimating lens.

15. The directional lamp as set forth in claim 1, wherein the planar light source is positioned along an optical axis of the beam forming optical system with the LED plane at a distance from the collimating lens that is within plus or minus ten percent of a focal length of the collimating lens and $D_o \geq 3D_s$.

16. The directional lamp as set forth in claim 1, wherein the planar light source is positioned along an optical axis of the beam forming optical system with the LED plane at a distance from the collimating lens that is within plus or minus ten percent of a focal length of the collimating lens and $D_o \geq 5D_s$.

17. The directional lamp as set forth in claim 1, wherein the planar light source is positioned along an optical axis of the beam forming optical system with the LED plane at a distance from the collimating lens that is within plus or minus ten percent of a focal length of the collimating lens and $D_o \geq 8D_s$.

18. The directional lamp as set forth in claim 1, wherein the exit aperture of the collecting reflector is at least three times larger than the entrance aperture of the collecting reflector.

19. The directional lamp as set forth in claim 1, wherein the exit aperture of the collecting reflector is at least five times larger than the entrance aperture of the collecting reflector.

20. The directional lamp as set forth in claim 1, wherein the exit aperture of the collecting reflector is at least eight times larger than the entrance aperture of the collecting reflector.

21. The directional lamp as set forth in claim 1, wherein the beam forming optical system satisfies both the etendue invariant and the skew invariant for the planar light source.

22. A directional lamp comprising:

a planar light source comprising one or more light emitting diode (LED) devices defining an LED plane;

a lens arranged to form light emitted by the planar light source into a light beam directed along an optical axis oriented perpendicular to the LED plane, the LED plane of the planar light source being spaced apart from the lens along the optical axis by a distance that is within plus or minus ten percent of a focal length of the lens; and a collecting reflector arranged to reflect light from the planar light source that misses the lens into the lens to contribute to the light beam, the collecting reflector having an entrance aperture of diameter $D_s$ receiving light from the planar light source and an exit aperture of diameter $D_o$ at which the lens is disposed;

wherein the light source, the lens, and the collecting reflector are secured together as a unitary lamp.

23. The directional lamp as set forth in claim 22, wherein $\theta_s$ is the half-angle of light emission of the planar light source, $\theta_o$ is the half-angle of light emission of the directional lamp, and $$D_o \geq \frac{\theta_s}{\theta_o} D_s \text{ and } D_s \leq \frac{\theta_o}{\theta_s} D_o.$$

24. The directional lamp as set forth in claim 22, wherein the LED plane of the planar light source is spaced apart from the lens along the optical axis by a distance that is different from the focal length of the lens wherein the light beam is defocused to smooth or eliminate visibly perceptible intensity and color non-uniformities in the beam pattern.

25. The directional lamp as set forth in claim 24, further comprising a diffuser cooperating with the defocusing to smooth or eliminate visibly perceptible intensity and color non-uniformities in the beam pattern.

26. The directional lamp as set forth in claim 22, wherein: $\theta_s$ is the half-angle of light emission of the planar light source and $\theta_s$ is at least 60 degrees, $\theta_o$ is the half-angle of light emission of the directional lamp, and $$D_o \geq \frac{\theta_s}{\theta_o} D_s \text{ and } D_s \leq \frac{\theta_o}{\theta_s} D_o.$$

27. The directional lamp as set forth in claim 26, wherein the lens is disposed along the optical axis between the diffuser and the planar light source.

28. The directional lamp as set forth in claim 27, wherein a scattering distribution produced by the diffuser for collimated input light has FWHM less than 40°.

29. The directional lamp as set forth in claim 27, wherein a scattering distribution produced by the diffuser for collimated input light has FWHM less than or about 10°.

30. The directional lamp as set forth in claim 22, wherein the reflector comprises a conical reflector.

31. The directional lamp as set forth in claim 30, wherein $f/D_o$ is less than or about one where f is the focal length of the lens.

32. The directional lamp as set forth in claim 22, wherein the planar light source further includes a light-mixing cavity defined by a reflective surface on which the one or more LEDs are disposed, a diffuser of diameter $D_s$ disposed at the entrance aperture of the collecting reflector, and reflective sidewalls connecting a perimeter of the reflective surface and a perimeter of the diffuser.

33. The directional lamp as set forth in claim 22, wherein the lens comprises a Fresnel lens.

34. The directional lamp as set forth in claim 22, wherein $f/D_s$ is less than or about 3.0 where f is the focal length of the lens.

35. The directional lamp as set forth in claim 22, wherein an optical system comprising at least the lens and the collecting reflector satisfies both the etendue invariant and the skew invariant for the planar light source.

* * * * *